United States Patent [19]

Redderson

[11] Patent Number: 4,794,752

[45] Date of Patent: Jan. 3, 1989

[54] VAPOR STIRLING HEAT MACHINE

[76] Inventor: Roy H. Redderson, 100 Winchester Way, Statesboro, Ga. 30458

[21] Appl. No.: 49,698

[22] Filed: May 14, 1987

[51] Int. Cl.[4] ..... F03C 5/00

[52] U.S. Cl. ..... 60/531; 60/517; 62/6

[58] Field of Search ..... 60/517, 521, 530, 531, 60/526; 62/6

[56] References Cited

U.S. PATENT DOCUMENTS

| | | | |
|---|---|---|---|
| 3,487,635 | 1/1970 | Prast et al. . | |
| 3,657,877 | 4/1972 | Huffman | 60/531 |
| 3,722,211 | 3/1973 | Conner et al. . | |
| 3,815,363 | 6/1974 | Huffman et al. | 60/531 |
| 4,413,475 | 11/1983 | Moscrip | 60/521 |
| 4,495,771 | 1/1985 | Chauveton | 60/525 |
| 4,543,788 | 10/1985 | Urzay | 60/531 |

OTHER PUBLICATIONS

Badr et al., "Thermodynamic and Thermophysical Properties of Organic Working Fluids for Rankine-Cycle Engines", Applied Energy, vol. 19, 1985, pp. 1–40.

Badr et al., "Selecting a Working Fluid for a Rankine--Cycle Engine", Applied Energy, vol. 21, 1985, pp. 1–42, 1985.

Jet Propulsion Laboratory, "Should We Have A New Engine? An Automobile Power Systems Evaluation", California Institute of Technology, Technical Reports, vol. II, chapters 1, 2, 6, 7; 1975.

Kolin, *The Evolution of the Heat Engine, Thermodynamics Atlas* 2, Longman Group Ltd., London, G.B., pp. 16–21, 55–59, 62, 64, 66–67, 69, 85, 89–92; 1972.

G. Walker, *Stirling Cycle Machines,* Clarendon Press, Oxford, G.B., chapters 1–4, 9, 10; 1973.

Yoshiki et al., "A Prediction of Stirling Engine Performance", JSME, vol. 28, No. 237, Mar. 1985, pp. 453–460.

*Primary Examiner*—Stephen F. Husar

*Attorney, Agent, or Firm*—Jones, Askew & Lunsford

[57] ABSTRACT

A heat machine which employs a condensing working fluid in a Stirling type mechanical arrangement. An initial mass of working fluid is contained within a closed space. Portions of hot and cold volumes are cyclically varied, which transfers a small percentage of the working fluid through large hot and cold heat exchangers interconnected with a periodic flow regenerator. With the exception of the regenerator space, the transferred working fluid is substantially in the liquid phase during the near isothermal heat rejection and compression stages, and substantially in the superheated vapor phase during the near isothermal heat addition and expansion stages. A control cylinder varies the effective mass of working fluid within the machine, so as to provide for output control. Decreasing the effective mass causes a shift in the operating cycle toward the superheated vapor region with lower mean pressure cycles, and increasing the mass causes a shift to the liquid region with higher mean pressure cycles. The large near isothermal heat exchangers assist in effective regeneration of the working fluid through the vapor dome, and further, provide considerable improvement in cycle thermal efficiencies. Also, the condensed working fluid requires less input work and the total cycle pressure/-volume characteristics exhibit greater output work, especially during the expansion phase, than do conventional Stirling machines.

34 Claims, 18 Drawing Sheets

GENERAL Pv DIAGRAM

PREFERRED EMBODIMENT Pv DIAGRAM

CONTROL MODE - reduced mass

CONTROL MODE - increased mass

ALTERNATE EMBODIMENT Pv DIAGRAM

ALTERNATE EMBODIMENT Pv DIAGRAM

VAPOR STIRLING HEAT MACHINE

TECHNICAL FIELD

The present invention relates generally to heat machines, and more particularly relates to a heat machine which operates in a thermodynamic cycle related to the Stirling cycle, the Rankine cycle, and the Ericsson cycle, in that the working fluid is subjected to Stirling cycle thermal processes but responds with Rankine cycle and Ericsson cycle properties, and which is controlled by varying the mass of working fluid subjected to the cycle.

BACKGROUND OF THE INVENTION

The Stirling cycle is a known thermodynamic process wherein an ideal gas in a closed volume is subjected to constant volume heating from a regenerator, allowed to expand isothermally to do work while heat is added from an external source, cooled in the regenerator at a constant volume, and isothermally compressed with heat transfer to an external dump. The Ericsson cycle is similar to the Stirling cycle, except that the ideal gas responds with isobaric regenerative processes instead of isometric ones.

The Rankine cycle is a somewhat different, but still well known, thermodynamic cycle. In this cycle, a liquid working fluid is heated and experiences a phase change into a gas or vapor at high pressure, the vapor is expanded through an engine such as a turbine to produce work, and, in the case of a closed system, the exhaust gas is condensed by heat rejection and the pumped liquid returned to the heater. However, the minimal work advantage of pumping a liquid is more than offset by the poor thermal efficiency of heat rejection during condensation and heat vaporization during expansion, without regenerative processes. Modified Rankine cycle systems employ reheat and staged regenerators to improve efficiency, but the heat addition no longer occurs at the maximum cycle temperature, as is required to approach Carnot efficiency.

The present invention, as well as the ideal Stirling cycle, operates on the principle that useful work and more optimum thermal efficiency can be obtained by partially compressing and partially expanding a working fluid within a closed volume, if at the same time a portion of the working fluid is transferred between a relatively constant hot temperature chamber and a relatively constant cold temperature chamber. These relatively isothermal hot and cold chambers are interconnected by a flow path that includes a regenerator, and are either supplying heat energy as a source reservoir or taking away heat energy as a sink reservoir. Further, provided these isothermal chambers are operating at the maximum cycle and minimum cycle temperatures, and provided that effective regeneration is utilized, then satisfies two of the several conditions that are necessary for approaching Carnot efficiency.

A regenerator, usually filled with a fine mesh material or the like, absorbs and stores thermal energy during that portion of the cycle when the working fluid passes through it moving from the hot chamber to the cold chamber. The regenerator then gives the stored thermal energy back to the working fluid as it moves from the cold chamber back to the hot chamber during a different portion of the cycle. The provision of this working regenerator is required if an actual machine is to more closely approach the unachievable Carnot efficiency of the ideal Stirling cycle, but its inclusion adds performance degradation, and it is sometimes not present in practical prior art Stirling cycle machines.

The "conventional" Stirling cycle, which is the practical implementation of the Stirling cycle in an actual machine, differs from the ideal Stirling cycle in several ways. The most notable difference is the discontinuous motion in the ideal cycle of the compression and expansion devices, e.g., pistons or diaphragms, versus the generally continuous motion in a practical machine. Moreover, the practical gas Stirling cycle suffers performance degradation due to the "dead volumes", i.e., those internal spaces that cannot practically be expanded or compressed. These dead volumes unavoidably occur in the void space of the regenerator (if one is used), in the connecting passageways, in the heat exchange chambers (if used), and in the cylinder or diaphragm clearance spaces and voids.

Additional shortcomings of conventional Stirling cycle machines include: non-isothermal compression and expansion since these would require infinite rates of heat transfer between the working fluid and the media on the outside of the hot and cold chambers; thermodynamically irreversible processes since friction and flow losses cannot be eliminated; and finally, imperfect regeneration since perfect implies infinite heat transfer. To overcome some of these shortcomings and produce practical outputs, many conventional gas Stirling cycle machines operate at extremely high mean pressures, at high source temperatures, at high volume flow rates with low density working fluids such as hydrogen and helium, and with swept volume ratios of 3 to 1 at best. These design solutions, however, lead to material problems, structural difficulties, leakage around piston seals, and a net effect of machines that to date have generally been uneconomical to market.

Accordingly, there is a need for a more efficient and practical heat machine which takes better practical advantage of the benefits of ideal thermodynamic cycles.

SUMMARY OF THE INVENTION

Briefly described, the present invention is a form of heat machine operating on a new thermodynamic cycle that is a combination of Stirling and Ericsson cycles, without valves, and, in terms of hardware, is most closely associated with a Stirling conventional gas machine. However, it also operates inside and near the vapor dome of the working fluid and therefore has working fluid properties related to a closed Rankine cycle engine with fluid vaporization and condensation.

It should be understood that the present invention has certain properties in common with known thermodynamic processes. The similarities are: (1) to that of a combination Ericsson cycle and an ideal Stirling cycle wherein the preferred embodiments of the present invention include two isobaric processes, two near isometric processes, and two near isothermal processes; (2) to that of an Ericsson thermodynamic cycle wherein embodiments of the present invention include two isobaric processes and two near isothermal processes; (3) to that of a Stirling thermodynamic cycle wherein alternative embodiments of the present invention include two near isometric processes and two near isothermal processes; and (4) with conventionally built Stirling gas machines wherein the present invention also has hot and cold varying volumes connected via a regenerator.

However, it should also be understood that the advantageous properties of the present invention are not found in any one known prior thermodynamic process, nor appear to be taught or suggested in the prior art.

More particularly described, the present invention comprises means for containing a working fluid in an overall closed space, in a constant mass throughout repeated cycles. Characteristic of the invention is that the working fluid exists during one cycle in varying volumes of sub-cooled liquid, saturated liquid, wet liquid-vapor, saturated vapor, and superheated vapor. Means are provided for subjecting the working fluid to compression during a portion of cycle. Means are also provided for removing or rejecting heat from the working fluid in a cold chamber, in a portion of the cycle corresponding to condensation of the working fluid. Means are also provided for heating the working fluid in a hot chamber. Expansion of the working fluid is resultant from the heating; if the machine is a prime mover, the expansion of the working fluid drives a movable element such as a piston. Finally, means are provided for occasionally altering the overall working fluid closed space volume, and hence the effective working fluid mass, to control the level of useful macine output.

A machine constructed in accordance with the present invention, whether connected singularly or in plurality, may find utility as (1) a heat engine, i.e., a prime mover in a power plant or similar work output device. In such an application, heat is supplied to the working fluid at some high temperature via a heating chamber, a portion of the heat is converted to useful output as either reciprocating or rotational shaft work via a restrained expansion process and the remainder of the heat is rejected at some lower temperature, usually near ambient, via a cooling chamber.

Another application of a machine constructed in accordance with the invention is as (2) a refrigerating machine, e.g., a cyrogenic device for liquifying fuels or gases. In a refrigeration application, separate shaft work input is provided to drive a cycle wherein heat is absorbed by the working fluid during expansion from a source reservoir at some lower temperature, to provide the useful result of lowered temperature. This heat is rejected during compression to a sink reservoir at some higher temperature, usually near ambient.

Yet still further, a machine constructed in accordance with the present invention may find utility as (3) a heat pump in heating, ventilating, and air conditioning (HVAC) equipment. In this application, separate work input is again provided to drive a cycle wherein heat is absorbed by the working fluid during expansion at some lower temperature (with the useful result being air conditioning), and rejected during compression at some higher temperature (with the useful result being heating).

The advantages of the present invention over other prime mover, refrigeration or heat pump machines are several. Such advantages include higher thermal efficiencies at given operating temperatures. This is possible because the resulting thermodynamic cycle more closely approaches the ideal Carnot thermal efficiency due to the use of post-expansion heat recovery with a regenerator. Greater efficiency also results from the use of large volume, approximately isothermal, heat exchangers on each end of the regenerator flow paths. Moreover, greater efficiency results from the operation of the isothermal hot and cold chambers at the minimum and maximum cycle temperatures. Yet still further, increased efficiency is possible because the external combustion heating means, if used, lends itself to continuous and therefore more controlled and complete combustion, and further allows for preheating of the supply air via a recuperator using the waste heat.

Other advantages of the present invention include a wide design choice of working fluids including those operating over 2000 degrees Farenheit such as the alkali metals—potassium and sodium and those operating at the very low temperatures of cyrogenic processes. Another advantage is the capability to operate with relatively small temperature differentials between the hot chamber and the cold chamber, thus providing the ability to convert low quality energy, such as solar generated low temperature hot water, to high quality energy such as electricity generated by shaft work. Yet another advantage is a superior performance with less complexity, e.g., no valves and with lower initial and operating costs, when compared to present internal combustion engines. That is to say, machines constructed in accordance with the present invention yield an equivalent output horsepower for a given engine size, yet with lower RPM, thereby providing longer engine life, considerably quieter operation, and most importantly, significantly less air pollution with the more controlled external combustion of the chosen solid, liquid, or gaseous fuel.

Accordingly, it is an object of the present invention to provide an improved thermodynamic cycle heat machine.

It is another object of the present invention to provide a heat machine which simultaneously possesses operational characteristics of a Rankine cycle, an Ericsson cycle, and a Stirling cycle, and combinations thereof.

It is another object of the present invention to provide an improved thermodynamic cycle heat machine with superior thermal efficiency.

It is another object of the present invention to provide an improved thermodynamic cycle heat engine whose output may be varied by selectively varying the effective mass of the working fluid.

It is another object of the present invention to provide an improved thermodynamic cycle heat machine which operates at or near the critical point of the working fluid.

It is another object of the present invention to provide an improved output control for a thermodynamic cycle heat machine which is independent of the combustion processes It is another object of the present invention to provide an improved output control for a thermodynamic cycle heat machine which does not depend upon rapid variation of the combustion processes or heat supplied to the cycle.

It is another object of the present invention to provide a practical thermodynamic cycle heat machine which can take advantage of the properties of from very low to very high temperature working fluids in a machine.

It is another object of the present invention to provide a heat machine which has less complexity and which has an increased swept volume ratio, with concomitant reductions in engine size.

These and other objects, features, and advantages of the present invention may be more clearly understood and appreciated from a review of the following detailed description of the disclosed embodiment and by reference to the appended drawings and claims.

DETAILED DESCRIPTION OF THE PREFERRED EMBODIMENT

Figure 1:
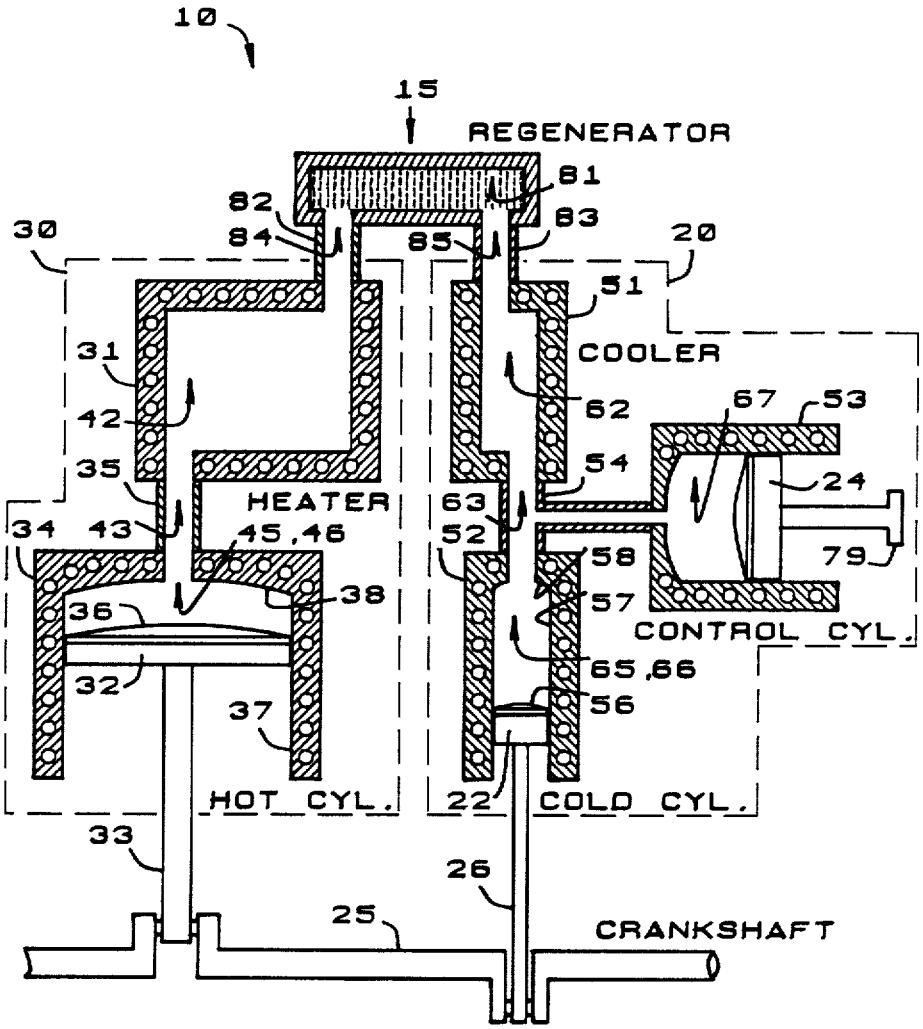
FIG. 1 is a simplified schematic diagram illustrating the preferred embodiment of a reciprocating heat engine constructed in accordance with present invention.

Referring now to the drawings, in which like numerals indicate like elements through out the several Figures, FIG. 1 illustrates a preferred embodiment of a reciprocating heat engine or machine 10 constructed in accordance with the present invention. The following detailed description and attached figures are pertinent to the heat engine application using pistons. It will be understood by those skilled in the art that the principles of operation to be described herein in connection with the disclosed embodiment are equally applicable for other types of heat machines, such as the aforementioned applications of a refrigeration machine and a heat pump machine, as well as apparatus which employ diaphragms in lieu of pistons. However, the basic thermodynamic cycle and the concepts are identical as that for the preferred embodiment of a prime mover, with the exceptions being that (1) the sequence of processes is in the reverse order, (2) the shaft work is an input (instead of an output), (3) the heat supplied during expansion is at the lower temperature, and (4) the heat rejected during compression is at the higher temperature, all as noted by many thermodynamic texts. Hence, the following description of the disclosed reciprocating heat engine also pertains, except as noted above, to the other applications previously listed.

Initial Thermodynamic Considerations

It should be understood from the outset that the present invention, when operating as a heat engine, comprises a thermodynamic cycle of four overlapping steps: (1) heat addition, (2) expansion, (3) heat rejection, and (4) compression. While these steps are separately listed, it will be understood that in practice, with a continuous movement reciprocating apparatus, the steps are never distinct and independent; portions of each step overlap in time with portions of other steps. It has been recognized in the art that sinusoidal piston motion results in working fluid being distributed in a cyclically time variant manner throughout the various temperature ranges.

There are several contrasts between the present invention and conventional gas Stirling machines. Firstly, preferred embodiments of the present invention intentionally include fixed relatively large size dead volume spaces in both the hot and cold chambers with very little dead volume performance degradation occurring. One reason for this is that the working fluid mass in the cold chamber, including the dead volume cooler space described below, stays primarily during each cycle in a sub-cooled liquid state. Since a sub-cooled liquid at moderate pressures can be considered an incompressible substance, the higher pressure portions of the cycle show no performance degradation, which is contrary to that which occurs in the dead space of a gas Stirling cold chamber. Further, the quantity of working fluid mass in the hot chamber, including dead volume heater space described below, is so significantly varied during portions of the cycle, due in part to the large swept volume ratio (i.e., there is a much larger hot variable volume than cold variable volume), that the provision of a large heater dead volume only slightly degrades the output performance, as shown below.

Secondly, the provision of these large, hot and cold, chamber fixed volumes, which function as heaters and coolers respectively, significantly improve the heat transfer between the working fluid and the heating and cooling media on the outside of the chambers. This therefore allows the heat addition and heat rejection processes to more closely approach the ideal isothermal processes, which require infinite rates of heat transfer.

Thirdly, the incorporation of these hot and cold heat exchangers on each side of the regenerator allows effective regeneration to occur since the working fluid must pass through these heat exchangers after compression and after expansion, and effective regeneration is essential for optimizing thermal efficiency.

Lastly, the use of the working fluid in the liquid, wet-vapor, and superheated vapor states, in lieu of a 100% gaseous state, can produce upwards of a ten-fold improvement in swept volume ratio, with the actual value depending on the particular working fluid and the operating temperatures used. This swept volume ratio improvement for the same output sized engine can result in a significantly lower mean pressure in the preferred embodiments when compared to an equivalent output conventional Stirling gas machine. In a similar manner, the volume flow rate can be reduced due to a higher mean density of working fluid being transferred through the regenerator. This results in more compact machines. It will be understood, however, that the use of the higher density working fluid will result in more fluid flow losses and resulting pressure drops, which will thus require larger cross sectional flow areas and lower machine operating speeds.

Those skilled in the art will recognize that many conventional thermodynamic analyses employ a temperature-entropy (TS) diagram to graphically illustrate various phenomena of a given thermodynamic process. Certain skilled artisans have stated that, in the case of sinusoidal piston motion which results in the working fluid being distributed in a cyclically time variant manner throughout the various temperature ranges, it is not believed possible to draw a meaningful TS diagram for the total mass of the working fluid. See, e.g., G. Walker, STIRLING-CYCLE MACHINES, p. 20 (Clarendon Press•Oxford, 1973). It is possible to draw TS diagrams for particular particles of the working fluid as they move from one temperature range to another, but no convenient way has been found to combine these multiple diagrams. Accordingly, no attempt has been made herein to graphically illustrate the operation of the present invention in the TS plane.

Description of the Preferred Heat Machine

Referring now in particular to FIG. 1, the working fluid operates inside a closed volume which comprises three of four principal elements: a regenerator chamber 15, and a cold chamber 20 having two pistons 22, 24 which vary portions of the total cold volume, and a hot chamber 30 having one piston 32 which varies a portion of the total hot volume. The three pistons 22, 24, 32 are each equipped in conventional fashion with standard sealing rings, such as metal piston rings, elastomeric seals, rollsocks, or the like (not shown). The piston 22 in the cold chamber 20 may be considered a "compression" piston, while the piston 32 in the hot chamber 30 may be considered an "expansion" piston. The working fluid rises in temperature during the compression and heat addition steps and cools during the expansion and heat rejection steps. The compression piston 22 in the cold chamber and the expansion piston 32 in the hot chamber are mechnically connected by a conventional driveshaft or crankshaft 25 with connecting rods, such that the two pistons 22, 32 are forced to move in a predetermined phase relationship. The resulting engine operation is one power stroke during the expansion step which occurs both once per thermodynamic cycle and once per mechanical revolution. Therefore, the disclosed embodiment can be classified as a two stroke, external combustion machine, as opposed to a standard automobile, gasoline or diesel, four-stroke internal combustion engine.

The other piston 24 in the cold chamber 20 is a "control" piston, and is selectively varied or moved periodically to effect changes in the total cold chamber volume. Movement of this piston controls the overall engine output, as will described further below.

Still referring to FIG. 1, further details of the preferred engine 10 will be provided. The crankshaft 25 is connected to the compression piston 22 via a connecting rod 26, and with the expansion piston 32 via a connecting rod 33. Although only two crankshaft connected pistons are shown in FIG. 1, i.e., it is a singular system, it is common knowledge in the art that a plurality of such cylinder and piston systems, whether using single-ended, double-ended, or opposed pistons, can be assembled in a wide variety of conventional and non-conventional open and enclosed housings, crankcases, and crankshaft configurations, e.g., in-line six, radial three, conventional V-8, and the like, with the resultant structure being called an "engine". None of these piston, cylinder, crankshaft, crankcase, multiple system engine configurations are shown herein or will be discussed further since they are all well known in the art.

The hot chamber 30 shown in FIG. 1 comprises a plurality of separate volumes interconnected with a passageway. These elements include a heater 31, a cylinder 34 within which piston 32 moves, and a connecting passageway 35. The passageway 35 provides a conduit for working fluid flow and has a fixed volume working fluid space 43. Heater 31, cylinder 34, and passageway 35 are maintained throughout each cycle at a relatively constant hot temperature by a medium (not shown) such as a hot liquid, which surrounds or encapsulates the hot chamber 30. Preferably, the medium is heated externally to the hot chamber 30, e.g. by external combustion products or solar energy. The heating medium and heating means are not shown in FIG. 1 since a wide variety of commercial means are available.

The heater 31 comprises a fixed volume working fluid space 42. The expansion piston 32 reciprocates along the axis of said cylinder 34. Piston 32 is connected to a conventional piston drive/connecting rod 33, that is in turn connected to the conventional rotational crankshaft 25, usually with an associated crankcase (not shown). Configuration details of crankshaft 25 and associated crankcase have been omitted since a wide variety of commercially available means is well known to the art.

The working fluid space bounded by the top head 36 of piston 32, the inner walls 37 of cylinder 34, the cylinder head 38 of cylinder 34, passageway 35, and heater 31 defines two separate volumes. These are best seen in FIG. 2C, when the expansion piston 32 is at bottom dead center. These are a variable volume working fluid space 45 whose volume is solely dependent on the position of piston 32; and secondly, a fixed volume working fluid space 46 comprised of both the clearance space between cylinder head 38 and piston head 36 at top dead center (TDC) and the passageway space in cylinder 34. In conventional fashion, each one full cycle of reciprocating motion by piston 32 produces, or is produced by, a one full cycle approximately sinusoidal change in the variable volume of working fluid space 45, as well as one full rotational revolution of crankshaft 25. The actual change in the volume of working fluid space 45 results from the slider-crank motion of piston 32, and this volume change more closely approaches sinusoidal if the length of drive-connecting rod 33 is made larger than the length of stroke of piston 32.

The preferred embodiment further comprises a cold chamber 20 shown in FIG. 1 as a combination of a cooler 51, a cold cylinder 52 in which compression piston 22 reciprocates, and a control cylinder 53 which contains the control piston 24. These elements 51, 52, 53 are interconnected with passageway 54 which provides a conduit for working fluid flow and has a fixed volume working fluid space 63. Cold chambers 20 and its associated elements 51, 52, 53 and passageway 54 are maintained throughout each cycle at a constant relatively cold temperature by a cooling medium (not shown), such as a cold liquid. Preferably, the cooling medium is external to or surrounds the cold chamber elements and passageway and is cooled by some other external cooling means, e.g., a radiator with heat exchange to ambient air. The external medium and cooling means are not shown in FIG. 1 since a wide variety of commercial means are available.

Cooler 51 comprises a fixed volume working fluid space 62. Cylinder 52 houses the compression piston 22, which reciprocates along the axis of the cylinder. Piston 22 is connected to a conventional piston drive/connecting rod 26, that is in turn connected to crankshaft 25, usually with an associated crankcase. The crankcase and crankshaft 25 details are again omitted except, as is common practice in the art, the two crankshaft 25 connections by the piston drive/connecting rods 26, 33 are such as to provide a phase displacement of about ninety degrees between the reciprocating motions of the compression piston 22 and expansion piston 32.

The working fluid space bounded by the top head 56 of piston 22, the inner walls 57 of cylinder 52, and the cylinder head 58 defines two volumes. These are best seen in FIGS. 1 and 2D and comprise a variable volume working fluid space 65 whose volume is solely dependent on the position of piston 22; and secondly, a fixed volume working fluid space 66 comprising the clearance space between cylinder head 58 and the top head 56 of piston 22 when at top dead center (TDC), and the passageway space in cylinder 52. In conventional fashion, each one full rotational revolution of crankshaft 25 produces one full cycle of reciprocating slider-crank motion by piston 22 which produces a one full cycle approximately sinusoidal change in the volume of fluid variable working space 65. The actual change in the volume of working fluid space 65 results from the slider-crank motion of piston 22, and this change more closely approaches sinusoidal if the length of drive/connecting rod 26 is made larger than the length of stroke of piston 22.

Control cylinder 53 houses the control piston 24 for selectively variable movement, for engine control; the piston 24 is confined to move along the axis of the cylinder. Piston 24 is connected to means for moving the piston along the cylinder 53, such as mechanical actuator 79. Details of the actuator 79 are ommited inasmuch as any of a wide variety of commercially available products can be used, e.g., a hand operated lever with locking positions, or a stepper motor with a helix shaft operated mechanism. Preferred embodiments employ an electronic controller (not illustrated) which move the piston 24 in selectable increments to provide for adjustments during engine operation. The control piston 24 usually remains stationary during repeated engine cycles and is only occasionally moved by actuator 79 to change engine output, as explained below. The working fluid space 67 in cold chamber 53 is therefore of constant volume over repeated cycles and is only occasionally varied to change engine output.

The preferred embodiment further comprises a regenerator chamber 15, as shown in FIG. 1. The regenerator 15 has a fixed volume working fluid space 81, which is defined as the volume remaining after the regenerator has been filled, or partially filled, with a suitable high thermal conductivity material for absorbing and rejecting heat as the working fluid passes thereinthrough, e.g., fine wire copper mesh. Regenerator 15 is connected to the hot chamber 30 via a working fluid passageway 82 on one end, and to the cold chamber 20 via a working fluid passageway 83 on the other end, thereby providing a conduit for the flow of working fluid in both directions between hot chamber 30 and cold chamber 20 through the regenerator. The passageways 82, 83 necessarily provide dead volumes 84, 85, respectively. However, since these volumes 84, 85 are openly connected to hot chamber 30 and cold chamber 20, respectively, they will hereinafter be included as portions of the other dead volumes in chambers 20, 30.

The regenerator chamber 15 in the preferred embodiment is preferably made of low thermal conductivity material such as ceramics or composites, of sufficient cross-sectional area, filled with a suitable density of high thermal conductivity material, all as suited to the temperatures, flow rates, and working fluid involved. For example, in the preferred embodiment, which employs Freon 113 as the working fluid, the regenerator can be filled with standard commercial copper wire cloth, 100 by 100 mesh per square inch having 0.0045 inch diameter wire and 0.0055 width openings, which if tightly packed in a given volume would result in an approximate 35 percent void space.

In summary, the total hot chamber 30 working fluid space comprises several distinct volumes, for analytical purposes: a hot variable volume 45 that varies approximately sinusoidally with movement of piston 32, and four other hot spaces 42, 43, 46, 84 of fixed volume. Similarly, the total working fluid space associated with the cold chamber 20 comprises several distinct volumes: a cold variable volume 65 that varies approximately sinusoidally with movement of piston 22, and five other cold spaces 62, 63, 66, 67, 85 that are of fixed volume. Finally, regenerator 15 has a fixed volume 81. Hence, in total, there are two spaces 45, 65 whose volumes vary approximately sinusoidally each machine cycle, nine spaces 42, 43, 46, 62, 63, 66, 81, 84, 85 whose volumes are fixed by machine construction, and one control space 67 whose volume is occasionally altered for machine control.

It will be appreciated that the previous description of hot chamber 30 with reciprocating expansion piston 32, cold chamber 20 with reciprocating compression piston 22, regenerator chamber 15, and crankshaft 25, comprise four primary elements of the preferred embodiment of the present invention, as well as describing a conventional closed gas Stirling cycle rotational engine. However, it will be understood that in the present invention, the operational parameters of the working fluid, the properties of the actual cycle, and the provision of a control element are not present in conventional Stirling cycle machines.

Further, in both the conventional Stirling gas cycle and the present invention, the working fluid pressure, typically measured in pounds of force per square inch absolute, should be approximately the same at a given small interval of time throughout the closed working fluid space of the engine. In practice, however, there are friction and flow losses that occur during flow portions of the cycle, which cause pressure variations in different portions of the machine. Accordingly, in the present invention, which uses a working fluid that is at times during the cycle part sub-cooled liquid, part wet vapor, and part superheated vapor, these friction and flow losses are minimized, the flow is primarily turbulent, and the pressure at any position in the cycle is relatively uniform, all by using high cross sectional area passageways and chambers, and operating the engine at relatively low speeds.

It should also be noted from the above descriptions of the various fixed volume working fluid spaces that the cylinder clearances, voids, and passageway spaces 43, 46, 63, 66, 84, 85 can generally be a relatively small portion of the total fixed volume spaces. Therefore, the majority of these fixed volume spaces can be considered as a part of the working fluid hot space 42 in hot chamber 30 and the cold space 62 in cold chamber 20. These spaces 42, 62 are connected to the respective ends of the regenerator 15 and if hot chamber 30 and cold chamber 20 are maintained at their respective desired, relatively constant temperatures, then spaces 42, 62 will be those wherein the majority of heat transfers occur, from and to the external hot and cold media, respectively, as the working fluid passes back and forth through the regenerator 15. Hence, in the present invention, hot chamber 30 will be functioning as a heater and cold chamber 20 as a cooler. The relatively large working fluid spaces 42, 62 can be advantageously used to improve, in conventional fashion, the necessary heat transfer surface areas such that the desired near isothermal temperatures can be maintained. It will also be shown later that these very desirable heat transfers can be achieved with minimal sacrifice of machine performance.

Variation of Operational Parameters

Two other essential considerations in the present invention, not known to exist in the prior art and that in effect makes both the present invention unique and permits it to produce an economical and practical output, are (1) the relative sizes of the several previously described variable and fixed, hot and cold, volumes, and (2) the quantity of effective working fluid mass in the system. The values of these parameters are in part determined from the hot and cold chamber operating temperatures, and the conventionally published thermodynamic properties of the selected working fluid, i.e., the saturated liquid specific volume at the cold chamber temperature and the saturated vapor specific volume at the hot chamber temperature.

Operation of the preferred heat engine of the present invention may be better understood with a description of the major heat engine parameters or variables, in terms of the operating results realized, for the preferred embodiment. The first group of variables to be selected must be the hot and cold operating temperatures and the working fluid. These three parameters are not only closely interrelated, but their choice determines the following: (1) the engine working fluid maximum and minimum pressures; (2) the engine construction materials needed to be suitable for the pressures and temperatures experienced and chemically compatible with the working fluid; and (3) the Carnot efficiency as a standard that the engine may approach but not exceed. The three variables are:

A. Hot Chamber 30 Operating Temperature-Value based on desired thermal efficiency and/or available heat source e.g., fossil fuel combustion, solar hot water, or the like. Those skilled in the art will understand that the higher the temperature differential between the hot and the cold chambers, the higher the engine thermal efficiency. A range of hot operating temperatures around the chosen temperature is satisfactory and will result in accompanying changes in engine output. Although this is not the preferred method of controlling output, it can be used in special applications where the time rate of change is not important.

B. Cold Chamber 20 Operating Temperature-Value based on desired thermal efficiency and/or available heat sink, e.g., ambient air. A range of cold operating temperatures is again satisfactory and will result in accompanying changes in engine performance, and this can also be used to control output in special applications.

C. Working Fluid-Chosen based on its pressure-temperature saturation curve, which then relates both the desired operating cold (sink) temperature to the resulting engine minimum pressure and the desired hot (source) temperatures to the resulting engine maximum pressure. Equally important is the fluid's flow and heat transfer properties. Considerable working fluid selection literature is available in the art, particularly for Rankine cycles and more recently for heat pipes. An example of the latter is U.S. Pat. No. 4,240,257 which lists 18 studied fluids, some of which are solids at room temperature; and for the former, a detailed study of 68 working fluids for a Rankine cycle engine operating between 120° C. and 40° C. by Badr, Probert and O'Callaghan in *Applied Energy*, Vol. 21, 1985.

In the disclosed embodiment, the preferred parameters are as follows:

A. Hot (source) temperature of 325° F. with preferable range of approximately 300° to 350° F.

B. Cold (sink) temperature of 100° F. with preferable range of approximately 50° to 150° F.

C. Working fluid of trichlorotrifluorethane, also known as fluorinated hydrocarbon 113, or Dupont Freon 113. It has a critical temperature of 417.4° F. and pressures as follows: 10.5 psia at 100° F. (cooler-sink temperature), 219.9 psia at 325° F. (heater-source temperature), and a 495.4 psia critical pressure. At the chosen sink and source temperatures respectively, the saturated liquid specific volume is 18.04 cu. in. per lbm. and the saturated vapor specific volume is 253.65 cu. in. per lbm. The ratio of these two specific volumes, i.e., 253.65 divided by 18.04 equals 14.06, will be used below to find the near optimum value of the cold variable volume space 65.

The next group of variables that need to be chosen are the various fixed and variable volumes, of which several are dependent on other variables:

D. Hot Variable Volume Space 45-Size based on the desired foot-pounds of output work and horespower. For later comparison purposes of the preferred embodiment with a conventional internal combustion engine, the hot cylinder 34 has a 4 inch bore, the connecting rod 33 is 6.5 inches in length, and the hot or expansion piston 32 has with a 4 inch stroke, which then defines a hot variable volume space 45 of 50 cu. in. when the hot piston 32 is at bottom dead center. This 50 cu. in. volume times 8 cylinders corresponds to the standard 400 cu. in. displacement of a Ford Motor Company V8 engine manufactured in the 1970's and last advertised in 1978 as 173 brake horespower at 3800 RPM.

E. Hot Fixed Volume Spaces 42, 43, 46, 84-Size based primarily on a compromise between the conflicting requirements of providing sufficient heat exchange surface area and minimizing any output performance degradation. As will be shown later, minimal degradation is achieved using a size of approximately 50% or within a range of 25% to 75% of the value of hot variable volume space 45. It will be recalled that this fixed volume 42 is functioning as a heater and therefore should be sized to obtain sufficient external surface area for the necessary heat transfer from the external medium to the internal working fluid. In the disclosed embodiment there is 25 cu. in. for the total volume, with approximately 20 cu. in. for the heater space 42 and 5 cu. in. for the passageway and void spaces 43, 46, 84.

F. Cold Variable Volume Space 65-Size and range based on the operating results realized as described below. The desired center value of the allowable range is computed as follows: add the hot fixed volumes 42, 43, 46, 84, the hot variable volume 45, the approximate regenerator volume 81, and divide that sum by the specific volume ratio given in C. above. For the preferred embodiment, this would be $(25+50+1)/14.06$ equals 5.4 cu. in. for cold variable volume space 65 when cold or compression piston 22 is at bottom dead center.

G. Cold Fixed Volume Spaces 62, 63, 66, 85-Size arbitrarily chosen except that it should be several times larger than the cold variable volume 65 since the cold space 62 is functioning as a cooler and should therefore be sized to obtain sufficient external surface area for the necessary heat transfer from the internal working fluid to the external heat transfer medium. For the disclosed embodiment, there is 15 cu. in. for the total volume, with approximately 10 cu. in. for the cooler space 62 and 5 cu. in. for the passageway and void spaces 63, 66, 85.

H. Regenerator Fixed Volume Space 81-Regenerator chamber 15 is sized based on variables A through E above and filled with a matrix that is a compromise between four conflicting considerations: (1) a large solid matrix is desirable for maximum heat capacity, (2) a small highly porous matrix is desirable for minimum flow losses, (3) a small dense matrix is desirable for minimum dead space, and (4) a large finely divided matrix is desirable for maximum heat transfer and highest thermal efficiency, all as reported by G. Walker, referenced above, and others. Those skilled in the art will understand that the choice between the different mesh and chamber dimensions must be made as a function of design tradeoffs in particular applications of the present invention. However, the final fixed space 81 in the regenerator does degrade engine output performance as shown below, and thus the generator choices must also consider the overall compromise between desired performance output and its thermal efficiency. The size of this void space 81 must be of less volume than cold variable volume space 65, and preferably is a number considerably less than half. For the disclosed embodiment, there is provided one-fourth of the space 65, or 1.35 cu. in. volume, for this regenerator void space 81.

I. Quantity of Working Fluid (mass) in the Closed System-This is believed to be a significant variable in terms of engine output and coincidentally, is the one most easily changed, although indirectly, for controlling engine output. This controlling mass quantity will be discussed below and then calculated for the numerical example.

J. Cold Control Volume Space 67-Size based on desired range of output control, e.g., 0%, to 100%, plus a reservoir for make-up of actual working fluid leakage from the non-perfect seals, rings, etc. of the ideal closed system. The disclosed embodiment has 10 cu. in. with the control piston 24 set at the 50% position, so as to give it an initial range of control of 10 cu. in. in either direction.

Operational Cycle of the Disclosed Embodiment

Turning to FIGS. 2A–2D, next will be described the general cyclical operation of the disclosed embodiment, followed by graphical illustrations of particular parameters. Beginning with FIG. 2A, it will be assumed that compression piston 22 is passing through its mid-point position and moving upwardly in the direction of arrows 91, and that the expansion piston 32 is at its top dead center position. This corresponds to the situation as shown in FIG. 3, wherein the crankshaft 25 is at the 90° position, immediately prior to the power or expansion stroke. Volume in the system is at a minimum at 90° and the working fluid is being further compressed and transferred by the movement of piston 22. Accordingly, heat input to the working fluid from regenerator 15 and heater 31 causes the transferred working fluid to expand as it passes through the wet vapor phase into superheated vapor, reaching maximum pressure as shown in FIG. 4 at 110°, forcing the expansion piston 32 downwardly.

Figure 2A:
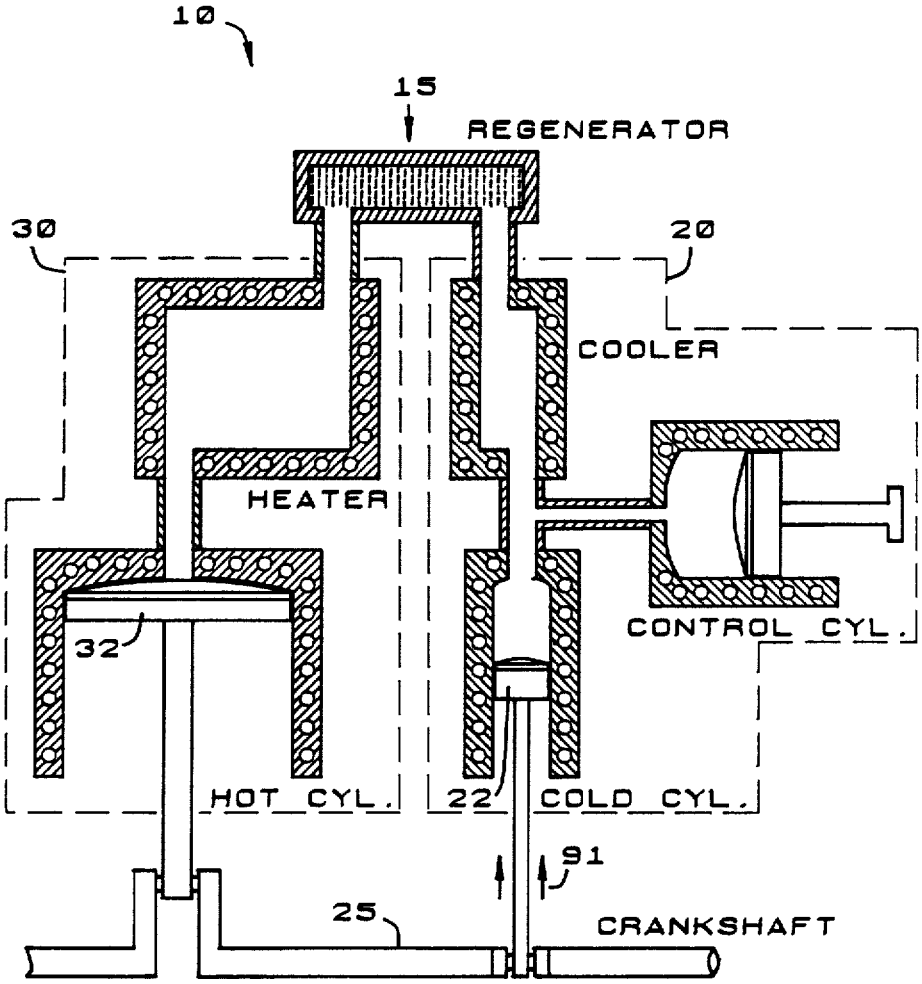
FIGS. 2A-2D illustrate various portions of the cycle in the preferred embodiment of FIG. 1.
Figure 2B:
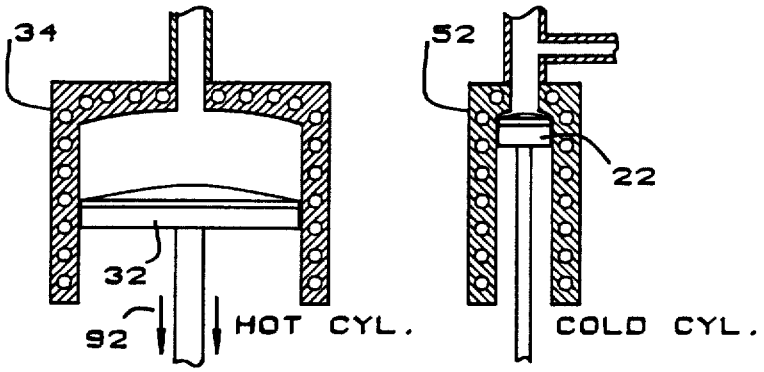
Figure 2C:
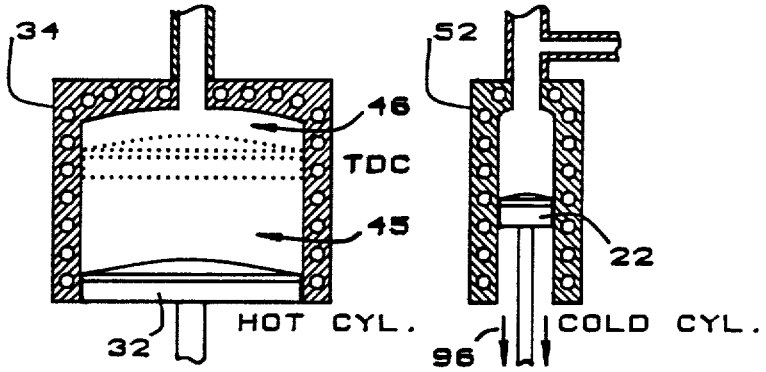
Figure 2D:
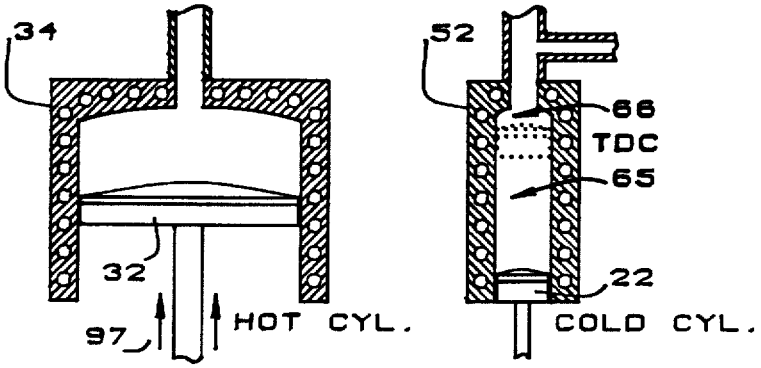
Figure 3:
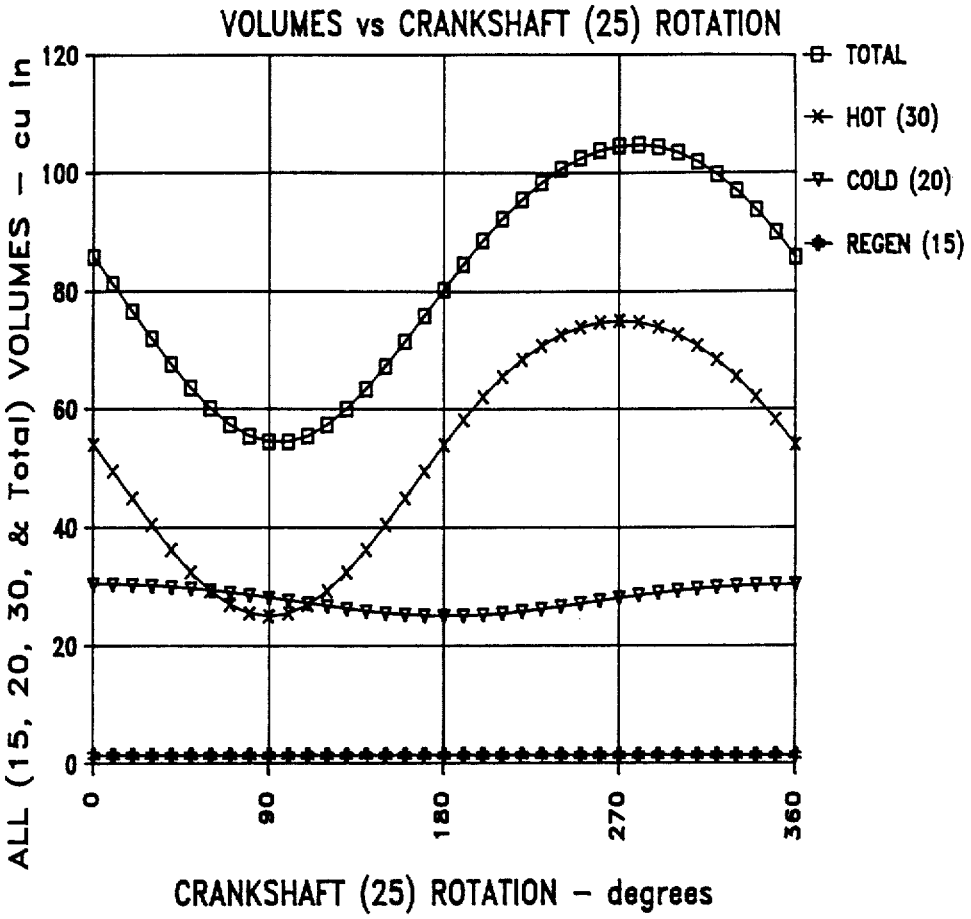
FIGS. 3 through 12 are graphs showing various operational parameters of the preferred embodiment illustrated in FIG. 1.
Figure 4:
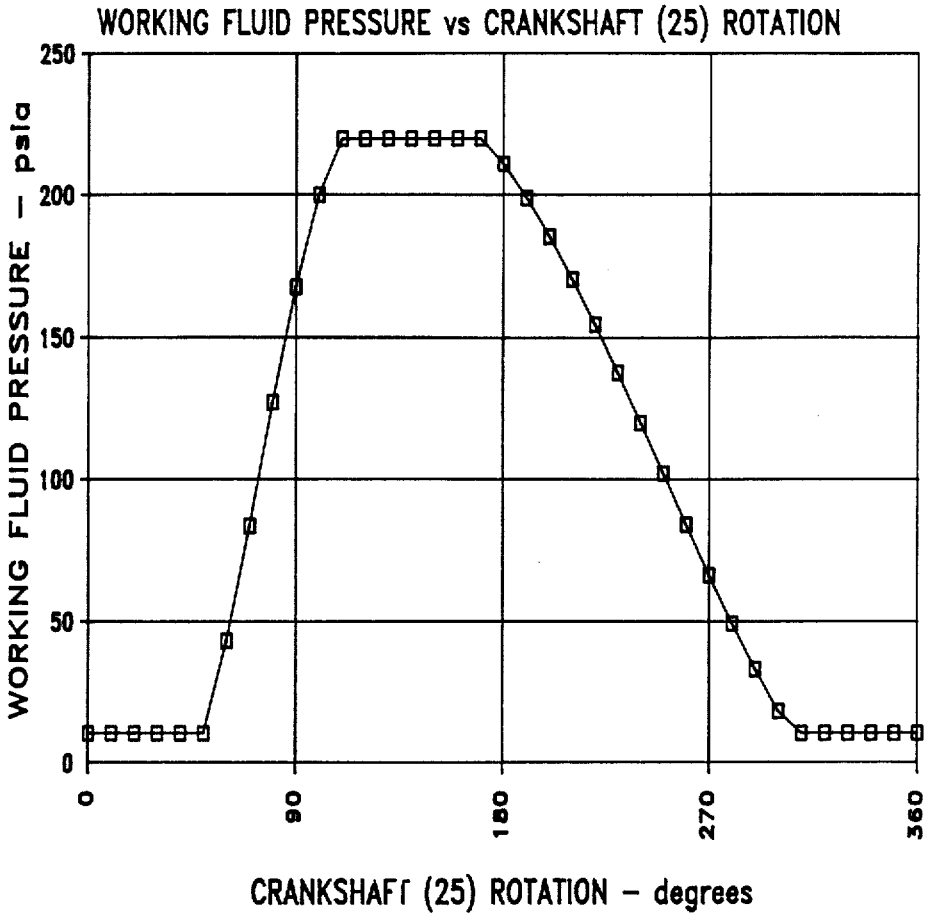

The expansion motion is shown in FIG. 2B, wherein the expansion piston 32 is moving downwardly in the direction of the arrows 92 and the compression piston 22 has completed moving upward to its top center position to minimum cold chamber volume as shown at the 180° crankshaft position of FIG. 3. Hence, the maximum working fluid has been moved to the hot chamber and as can be seen in FIG. 4, has resulted in the pressure in the system remaining constant at the maximum value from 110° through 170°. Thereafter, further movement of expansion piston 32 results in a decreasing system pressure from crankshaft position 170° through about 360°.

In FIG. 2C, the compression piston 22 is at midpoint between the extremes of its movement downwardly as shown by arrows 96, while the expansion piston 32 is at bottom dead center, corresponding to crankshaft position 270°. At this point, the total volume is at maximum value after having completed the expansion process and having begun the transfer of working fluid into cooling chamber 20. The next motions of the pistons 22, 32 continue to transfer the working fluid back into the cooling chamber 20 for cooling and eventual compression.

In FIG. 2D, the expansion piston 32 is at midpoint between the extremes of its upward movement as shown by the direction arrows 97. The compression piston 22 has completed its downward movement and is at bottom dead center ready to begin moving upward in compression, which corresponds to the range of 270° through 0° to 90°, which returns to the configuration of FIG. 2A. It should be noted, as can also be clearly seen by the cyclical operation shown in FIGS. 2A–2D, that the expansion piston 32 "leads" the compression piston 22 by approximately 90° of crankshaft rotation.

In FIG. 3 there is a is a graphical illustration wherein the different volumes in the disclosed embodiment are each plotted as a function of cycle position, with the latter being delineated by crankshaft 25 in degrees of rotational position, i.e., through one revolution of 360° with a plotted data point every 10° and an arbitrary beginning 0° point. Specifically, it shows hot chamber 30 containing a working fluid volume that varies approximately sinusoidally from 25 cu. in. minimum at 90° to 75 cu. in. maximum at 270°, a cold chamber 20 containing a working fluid volume that changes approximately sinusoidally from 30.4 cu. in. maximum at 0° to 25 cu. in. minimum at 180°, a regenerator chamber 15 containing a working fluid volume that is fixed at 1.35 cu. in., and a total working fluid volume in chambers 30, 20, 15 that is the instantaneous sum of the above three and that changes approximately sinusoidally from 104.67 cu. in. maximum to 54.36 cu. in. minimum. It should be again noted that the approximately sinusoidal volume variation in the hot chamber 30 versus the approximately sinusoidal volume variation in the cold chamber 20 are out of phase by approximately 90°, with the hot said to be leading the cold by approximately 90°.

Particular note should be taken of the very high swept volume ratio which, for the disclosed embodiment, is the 50 cu. in. of working fluid variable volume space 45 (hot cylinder displacement) divided by the 5.4 cu. in. variable space 65 (cold cylinder displacement). Thus, the disclosed embodiment has a 9.3 swept volume ratio. It is believed that this ha particular significance in the present invention, inasmuch as swept volume ratios in prior art Stirling machines are on the order of 0.5–2.5, e.g., G. Walker, referenced above, p. 131. Accordingly, it is believed that the use of working fluid having such a wide range of pressure characteristics, and operated in transition from liquid to gaseous phase as in a Rankine cycle, provides benefits and advantages in operation not suggested or anticipated in the prior art.

Lastly, in FIG. 3 the total volume curve shows compression occurring from approximately 280° through zero degrees to approximately 100° with inherent work input for an engine, and restrained expansion occurring from approximately 100° to 280° with inherent work output.

Analytical Calculations of the Disclosed Embodiments

Numerical analysis of preferred embodiments of the present invention is based in part on the general theory of Stirling engines developed by Professor Gustav Schmidt in 1871 and still known in the art today as a valid analysis procedure. The Schmidt method is based on the fact that the total mass of all the working fluid remains a constant since it is contained in a closed working fluid space, and therefore, the sum of the masses from the three working fluid chamgers 15, 20, 30 must alway equal the same total mass constant. Also, since the chambers are all openly interconnected, with large cross-sectional areas to minimize flow losses and pressure drops, the pressure of the working fluid can be assumed to be the same throughout the chambers. Further, since the mass in hot chamber 30 and the mass in cold chamber 20 each exists at the relatively constant source and sink temperatures throughout each respective chamber and throughout each cycle, the value of working fluid mass in each chamber at a particular crankshaft position is simply the volume of that chamber at that crankshaft position divided by the respective specific volume of the working fluid at that chamber's isothermic temperature and the engine's pressure.

It will be understood that the classical Schmidt analysis of a Stirling cycle is premised upon the working fluid being an ideal gas. However, portions of the Schmidt method can also be used in the analytical analysis of a vapor cycle Stirling, as in the present invention. First, a "simple" compressible system has been defined as a system for which the only quasistatic work interaction is boundary (PdV) work, which applies to the present invention. Further, the state postulate of thermodynamics specifies that for such a simple system, only two independent intrinsic properties are required to fix the equilibrium state (intensive properties) of a simple substance working fluid, regardless of whether it is in the liquid, vapor or gas state. Hence, of the two independent properties, the temperatures of chambers 20, 30 was already chosen as previously described, and only one other independent intrinsic property must be found for each of the two chambers, i.e., two unknowns. However, because this one independent variable for each of the two chambers must also satisfy (1) the Schmidt assumption of equal pressure throughout, (2) the two extensive properties of the calculated cold chamber 20 and hot chamber 30 actual volumes (at each crankshaft position) per Schmidt, and (3) the Schmidt fact that the sum of the masses in the chambers must always equal the constant total enclosed mass, there is therefore sufficient known relationships to effect a solution at each crankshaft position. It is simply a matter of iteratively solving for the one system pressure, at each crankshaft position, that will permit the corresponding hot and cold chamber specific volumes to satisfy (2) and (3) above, using standard thermodynamic properties (interpolated tabular data or derived equations) of the selected working fluid.

It will also be understood that in the present invention, the working fluid is subjected to Stirling type processes and responds with Rankine cycle properties, either as a vapor cycle as previously described, or as a supercritical cycle wherein the system pressure is above the critical pressure of the working fluid and the phenomenon of boiling does not exist. At such pressures there is never any time in a constant-pressure heating process when the temperature remains constant, and liquid and gas become distinct phases in a mixture. Instead, the fluid, remaining always homogeneous, simply becomes gradually less dense, with no distinction between liquid and gas. Sometimes the arbitrary rule is followed that the liquid becomes a gas when it passes the critical temperature. For these reasons, it is believed that the described modified Schmidt technique will also prove to be accurate in analyzing these embodiments of the present invention that are above the critical pressure of the working fluid. Those skilled in the art will recognize, therefore, that the objects of the present invention are achieved at least in part by the operation of the working fluid in a vapor or supercritical Rankine cycle, in a Stirling cycle process.

Other assumptions for analytical calculations of the present invention are: (1) that since the working fluid in cold chamber 20 can and is made to stay in or near the liquid state throughout most of each cycle by proper choice of the various volumes and total working fluid mass, and since the pressures involved in a cycle are relatively low, this liquid can be assumed to approach non-compressibility. Therefore, it is further assumed that the working fluid in cold chamber 20 is always either at the saturated liquid specific volume, even when sub-cooled to the system maximum higher pressures, or it is near the liquid saturated state in the wet liquid-vapor region. (2) The working fluid mass in the regenerator chamber void space 81 can be evaluated by assuming that the flow through the regenerator from zero to 180° of crankshaft position is from cold chamber 20 to hot chamber 30, and from 180° to 360° the flow is in the reverse direction. Therefore, the regenerator volume 81 can be assumed to be made up of a changing percentage of cold space and hot space, i.e., regenerator space 81 is 100% hot space at zero crankshaft degrees, approximately 50% hot space and 50% cold space at 90°, 100% cold space at 180°, approximately 50% hot and 50% cold at 270°, and 100% hot at 360°.

Accordingly, the following are the known quantities for use in Schmidt's method: (1) the total mass in the system, (2) the thermodynamic properties of the working fluid (temperature, pressure and specific volumes for saturated liquid, saturated vapor, and superheated vapor), and (3) the respective chamber volumes at each crankshaft position (see FIG. 3). It is then possible to analytically determine for each crankshaft position: (a) the specific volumes in each chamber, (b) the mass in each chamber, and (c) the pressure existing throughout the chambers.

Theoretical Pv Diagrams of the Disclosed Embodiments

Before reviewing the results of the numerical analysis of the present invention in the manner described in the preceding section, it is appropriate to pause at this point and discuss the expected theoretical results. In particular, it is believed that the present invention provides a new thermodynamic cycle. This being the case, it is difficult to accurately predict the actual results in a machine constructed and operated in accordance with the invention. Traditional analytical methods, though useful where the thermodynamic process is well known, may not provide adequate illumination on the operation of the present invention, which is believed to combine aspects of several theoretically different thermodynamic cycles. Accordingly, it will be understood that the expected results may not always be in exact accordance with the actual results.

Figure 5A:
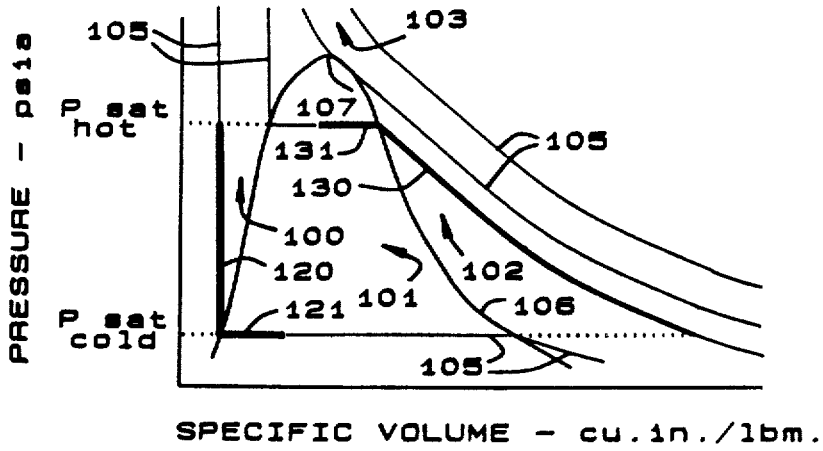
Figure 5B:
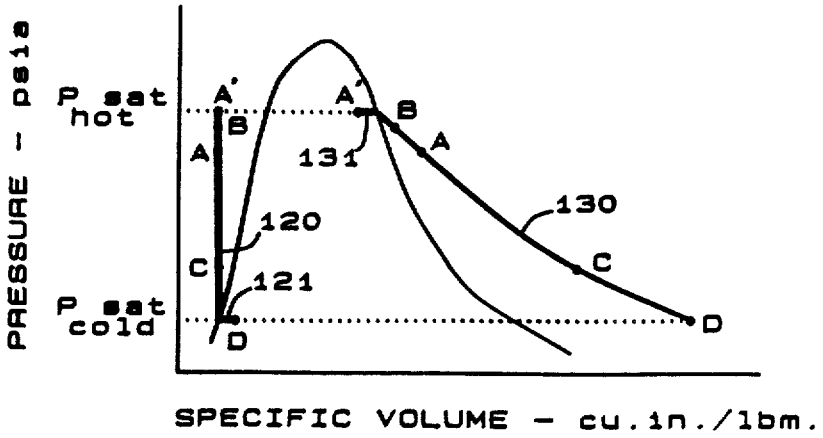

FIG. 5, consisting of FIGS. 5A and 5B, are general diagrams of the theoretical expected Pv results in the present invention, superimposed on the vapor dome 106 of a chosen working fluid. The bold lines 120, 121, 130, 131 represent the expected states of the working fluid at various stages in the cycle. In this diagram, the region 100 represents the subcooled liquid region of the working fluid. In the region 100, the temperature is below the saturation temperature of the working fluid corresponding to its pressure. It will also be understood that this is alternately called a "compressed liquid" region, which is defined as a state whose pressure is higher than the saturation pressure corresponding to its temperature. Either explanation is acceptable in the art, being somewhat akin to the difficulty of describing a half-filled glass as "half full" or "half empty". Region 101 is of course the wet liquid-vapor region, inside the vapor dome.

Region 102 is the superheated vapor region. This is a state whose temperature is greater than the saturation temperature corresponding to its pressure, or alternately, the state whose pressure is less than the saturation pressure corresponding to its temperature. This region also applies to temperatures above the critical temperature. However, above the critical temperature there is no phase of the working fluid that can be liquid. Region 103 is the supercritical region, that is, above the critical pressure.

The lines 105 generally represent isotherms, that is, lines of pressure and volume which can exist at constant temperature. These lines include those above and below the critical temperature, those horizontal lines inside the vapor dome, and those nearly vertical lines in the subcooled liquid region. The vapor dome 106 is represented on the left by the saturated liquid line and on the right by the saturated vapor line. Point 107 is of course the critical point, the maximum point of temperature and pressure above which there is no discernable division between gas and liquid phases.

It is believed that in the present invention, operation occurs along four isotherms 120, 121, 130, and 131. Isotherm 120, in the subcooled liquid region, occurs inside the cold chamber 20 during the substantially isothermal compression of the working fluid in the cold chamber. Isotherm 121 is a wet liquid-vapor isotherm, expected in the cold chamber 20 during the substantially isobaric transfer of working fluid into the cold chamber. Isotherm 130 occurs in the hot chamber 30, with the working fluid in a superheated vapor state, during the substantially isothermal expansion of the working fluid. Isotherm 131 also occurs in the hot chamber 30, when the working fluid is in a wet liquid-vapor state, during the isobaric transfer of working fluid into the hot chamber The connections between these isotherms are not shown in FIG. 5, it being understood that these "connections" represent the state of the working fluid in the regenerator chamber 15. It is believed that the transition between the isotherms 120, 121 of the cold chamber and the isotherms 130, 131 of the hot chamber are substantially isobaric because of the requirement that the regenerator have a wide cross sectional area. However, it should be understood that the process within the regenerator, by definition, is a transfer of heat to and from the high thermal conductivity material, as denoted by the thermodynamic change in internal energy of the working fluid that is alternately transferred between the isothermic cold and hot chambers 20, 30.

Referring now to FIG. 5B, the points A, B, C, and D (on both the cold and hot isotherms) correspond to the equal pressure that occurs simultaneously in both chambers at each of the piston positions denoted by FIGS. 2A, 2B, 2C, and 2D, respectively. Obviously, point A' is between point A and point B; it is also at the 136° lowest hot side quality point.

Results of the Analytical Analysis

FIGS. 4 and 6–11 depict the operation of the preferred heat engine of the present invention using values from the numerical example and using the analytical methods described above. It should be noted that the crankshaft 25 rotational positions shown in the various figures are all beginning at the same zero degree point and ending at the same 360° point, with it being understood that the following cycle begins again at zero degrees. Secondly, it should also be noted that the graphical illustrations in FIGS. 4 and 6–11 are in part derived from an analytical model using some assumptions and that the illustrations are only included to help explain the thermodynamics of the engine cycle and operation of the disclosed embodiment of the present invention; they are not in any sense meant to be a limiting or fixed parameter of the present invention.

FIG. 4 is a graphical illustration for the numerical example of the resulting heat engine working fluid pressure in pounds per square inch absolute ("psia") plotted as a function of the crankshaft 25 rotational position. Note that the engine is operating approximately one-fourth of each cycle at the hot temperature saturation pressure of 219.9 psia, one-fourth at the cold temperature saturation pressure of 10.5 psia, and the remaining one-half in transition between the two constant saturation pressure values.

Figure 6:
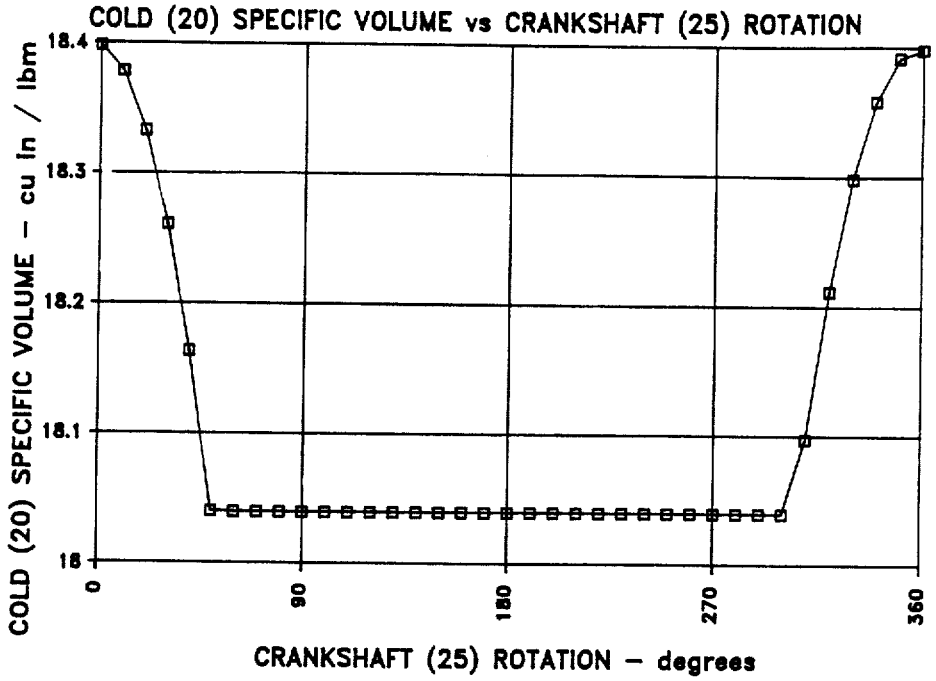
Figure 7:
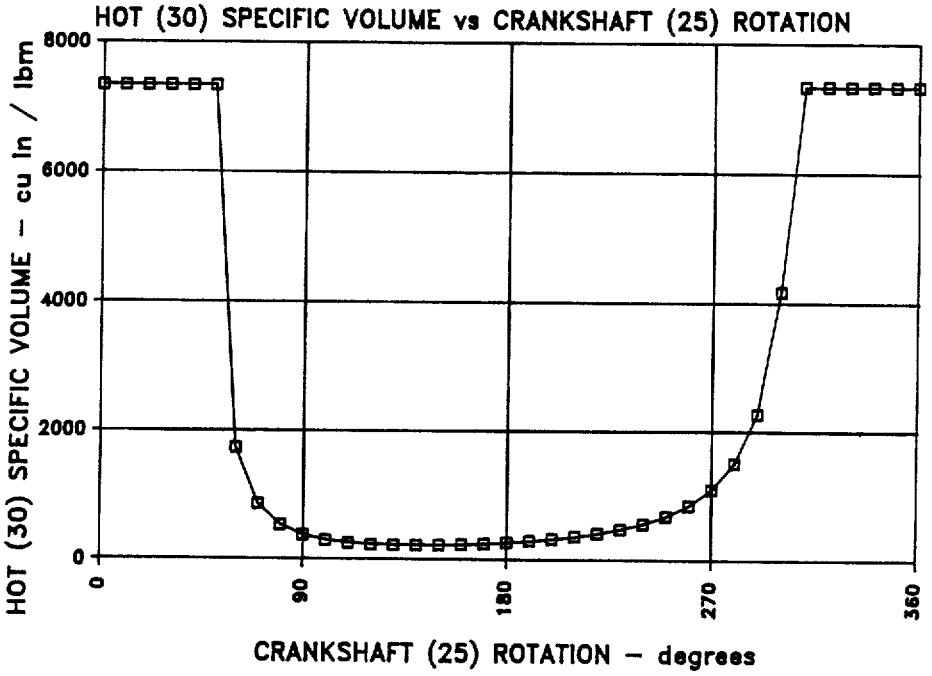

FIGS. 6 and 7 are graphical illustrations of the cold chamber 20 and hot chamber 30 specific volumes plotted as a function of crankshaft 25 position. The specific volume values shown are the standard isothermal data of Freon 113 at the respective source and sink temperatures, with the pressures corresponding to FIG. 4.

Figure 8:
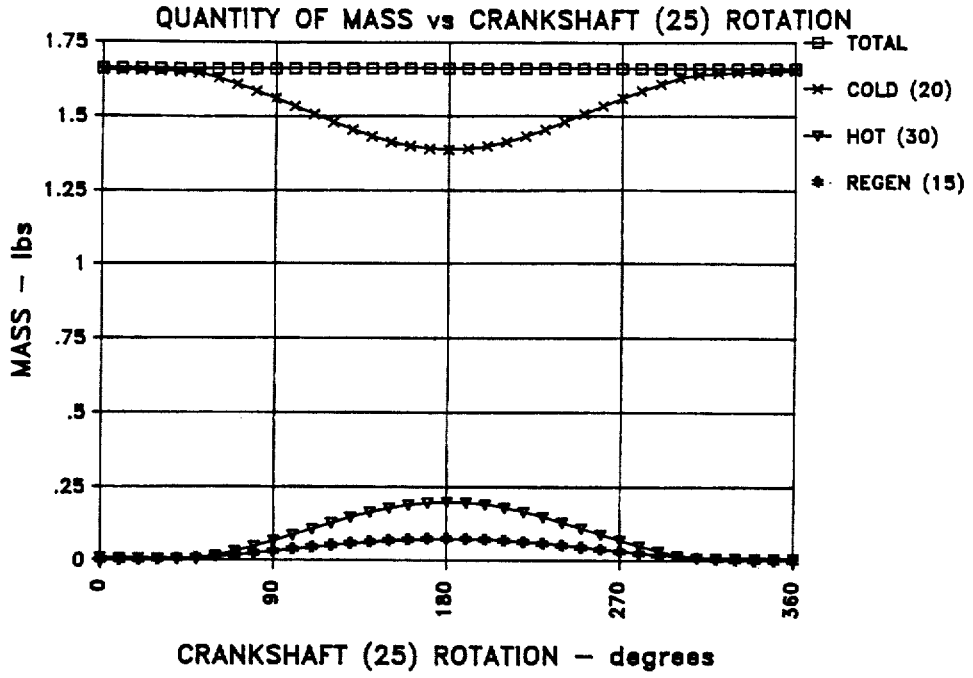

FIG. 8 is a graphical illustration of the working fluid mass variations for the hot 30, cold 20, and regenerator 15 chambers plotted as a function of crankshaft 25 position. Points to be noted are: (1) the total mass is a constant, (2) the quantity of mass transferred to the hot chamber and the regenerator from the 90° to 270° crankshaft positions (during the expansion process ) is significantly greater than the quantity resident at 0°, even with the large hot chamber dead volume heat exchanger, and (3) only a small portion, less than 15%, of the total cold mass is moved through the regenerator to the hot chamber. These variations of mass are as a result of operating the cycle in and near the vapor dome with both the aforementioned swept volume ratio and the respective volume determinations. However, the benefits realized from these particular mass variations are significant in that large hot and cold heat exchange chambers are allowed (with minimal performance degradation to be shown later), and that these chambers then provide improved heat transfer, closer to isothermal processes, effective regeneration, and higher overall thermal efficiencies.

Figure 9:
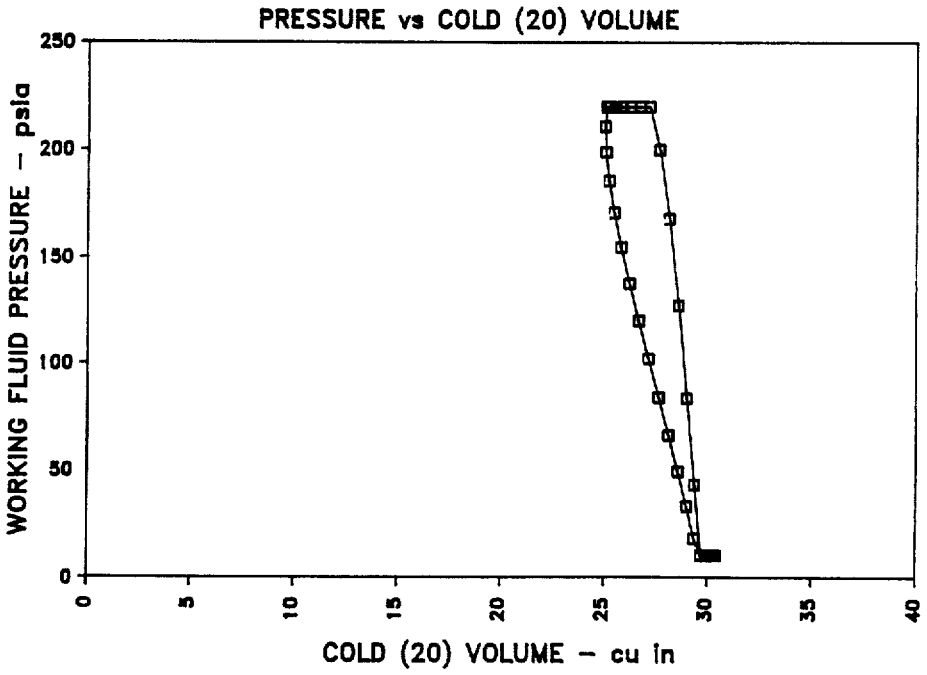
Figure 10:
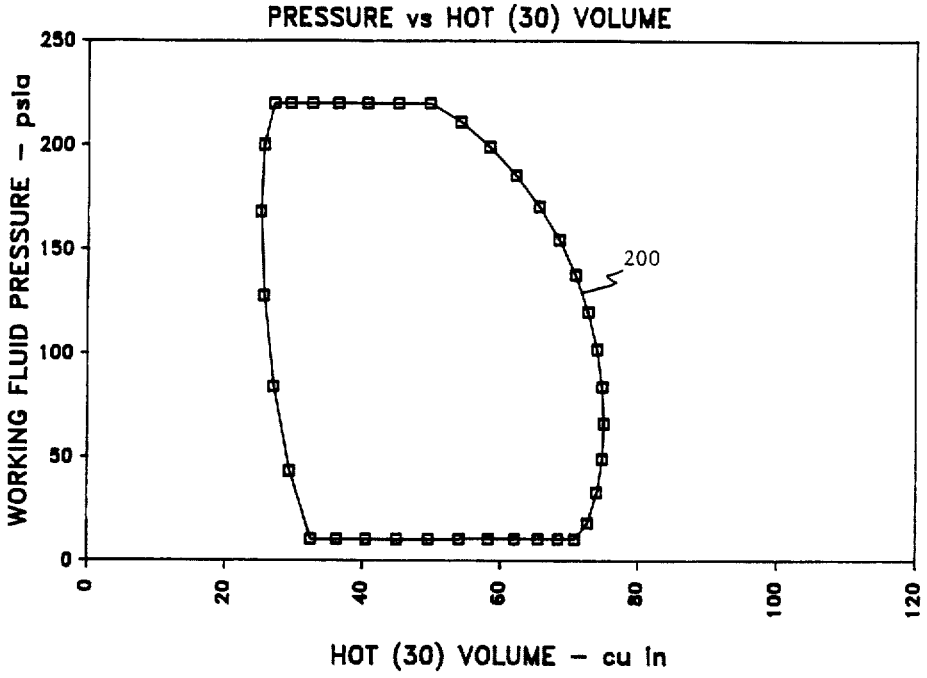
Figure 11:
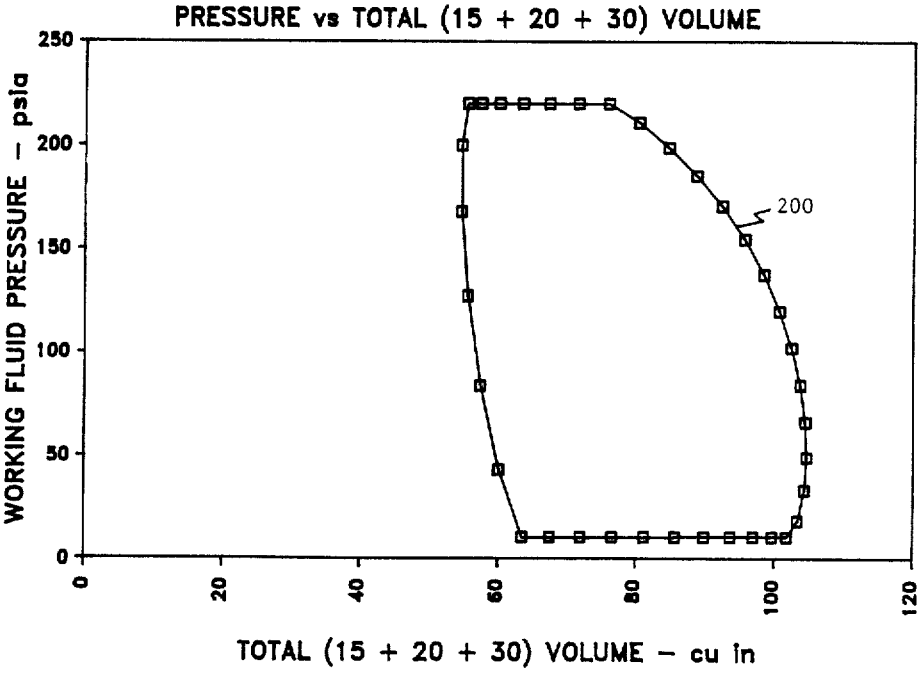

FIGS. 9–11 are graphical illustrations of the working fluid pressure plotted as a function of chamber working fluid volume. It should be noted that the shape of these pressure/volume (PV) curves differ substantially from that expected for conventional Stirling cycle engines. The shape bears the closest resemblance to that of the Ericsson cycle, with its regions of constant pressure, but the transitional curve segment 200 in FIGS. 10 and 11 that goes from high pressure to low pressure is somewhat convex in shape. This is to be contrasted with the same region on a conventional Ericsson cycle, which is concave in shape. Inasmuch as the work produced in the cycle is the area under the PV curve, it will be appreciated that the convex curve shown in FIGS. 10 and 11 provides greater work output than expected from an Ericsson cycle machine.

Note in connection with FIG. 9 that the area under the PV curve represents work into the system to compress the cold chamber working fluid which in the present invention is in or near the liquid state throughout each cycle. Since substantially less work is required to compress a liquid, as versus a gas in a conventional Stirling, the present invention again provides greater net work output. Finally, the overall shape of the PV curve of FIG. 11 most closely resembles two isobaric processes, two near isothermal processes, and two near isometric processes, i.e., it is believed that the preferred embodiment of the present invention is a combination of Ericsson and Stirling thermodynamic cycles.

The operating principles of the present invention can be still further explained using the numerical examples in that they show a 219.9 psia working fluid pressure occurring from 110° to 170° of crankshaft rotation. During this interval there is sufficient mass pushed into the hot chamber through the regenerator 15 to force the near isothermal hot chamber mass to leave the lower pressure superheated vapor state and enter the constant pressure, hot temperature, wet liquid-vapor state, with the lowest hot chamber vapor quality of 0.85 occurring at 136°. From 170° through 0° to 110°, the hot chamber is in the superheated vapor state with corresponding pressures lower than the 219.9 psia hot side saturation pressure. Also, from 50° to 306°, the cold chamber mass is pressurized above the cold temperature liquid saturation state and remains as a sub-cooled liquid, in accordance with the noncompressibility assumption. The 10.5 psia working fluid pressure that occurs from 306° through 0° to 50° comes about because the near isothermal cold chamber volume has increased sufficiently for the chamber mass to pass into the wet liquid-vapor state, with the highest cold chamber vapor quality of 0.00007 occurring at 358°; and at the same time, the hot chamber mass is superheated to a pressure which normally would be less than the 10.5 psia. Hence, only during that part of the cycle from 306° through 0° to 50° is the pressure of the cold chamber dictating the working fluid pressure to the hot chamber; during the remainder of the cycle, the hot side dictates the pressure to the cold.

In summary then, the principle operating cycle of the numerical example can be described as a near isothermic cold chamber with a working fluid that is in a liquid saturated or sub-cooled state for approximately three-fourths of each cycle and in a wet liquid-vapor (low constant pressure) state for the other one-fourth of each cycle, and simultaneously, a near isothermic hot chamber with a working fluid that is in a superheated vapor state for approximately three-fourths of each cycle and in a wet liquid-vapor (high constant pressure) state for the other one-fourth of each cycle.

Other analytically derived data from the disclosed embodiment numerical examples includes: Carnot efficiency equals 28.7% ; working mass equals 1.65991 lbs of Freon 113; and in conventional fashion, numerical integration of the areas of the pressure-volume (PV) plots of FIGS. 9–11 provide the work per cycle in ft-lbs with compression (work in) form FIG. 9 equal to 29.8 ft-lbs, expansion (work out) from 10 equal to 741.3 ft-lbs, and net work output from either FIG. 11 or from FIG. 10 minus FIG. 9 equal to 711.5 ft-lbs. Note that in conventional fashion, actual work indicator diagrams of the three pressure-volume areas would show an actual difference between FIG. 10 minus FIG. 9 versus FIG. 11 and this difference in ft-lbs would be the flow losses (assumed zero in this example).

It will be appreciated that at a nominal rotational speed of 1000 RPM, the net 711.5 ft-lbs output would result in a 21.6 theoretical horsepower engine. Using this numerical example engine, i.e., 50 cubic inch hot displacement volume and 5.4 cubic inch cold displacement, when connected in a plurality of eight (as in the previously described Ford V-8 400 cubic inch displacement engine with an output of 173 brake horsepower at 3800 RPM), results in an almost identical 172.6 theoretical horsepower engine. However, the disclosed heat engine of the present invention is arbitrarily operating at the much lower 1000 RPM speed as dicatated by having to pump liquig or low quality wet vapor through the passageways and regenerator during portions of each cycle. The actual RPM value in engines constructed in accordance with the present invention may vary considerably as a result of different engine configurations, different lengths and areas of passageways, different quantities of enclosed mass, and different relative volumes for the various engine spaces. Accordingly, the 1000 RPM of the disclosed embodiment is merely exemplary.

Analysis of Control Aspects.

Next will be discussed the control aspects of the present invention, which result from variation of the mass of working fluid by the control piston 24. As previously mentioned, variable output engine control can be accomplished (albeit slowly) by varying the hot 30 or cold 20 chamber temperatures, but this control is most easily accomplished by indirectly changing the enclosed mass using control volume 67. As discussed above in connecting with FIG. 1, control cylinder 53 with control piston 24 operated by mechanical actuator 79 provides these occasional control changes to the working fluid mass by simply increasing or reducing the cold volume working fluid space. This control adjustment is made at some point in time after the engine is initally filled with an initial quantity of mass as determined with piston 24 initially set approximately at the half-way point. Operation at this "nominal" setting is shown in FIGS. 4, 6–11, and 17.

Figure 12:
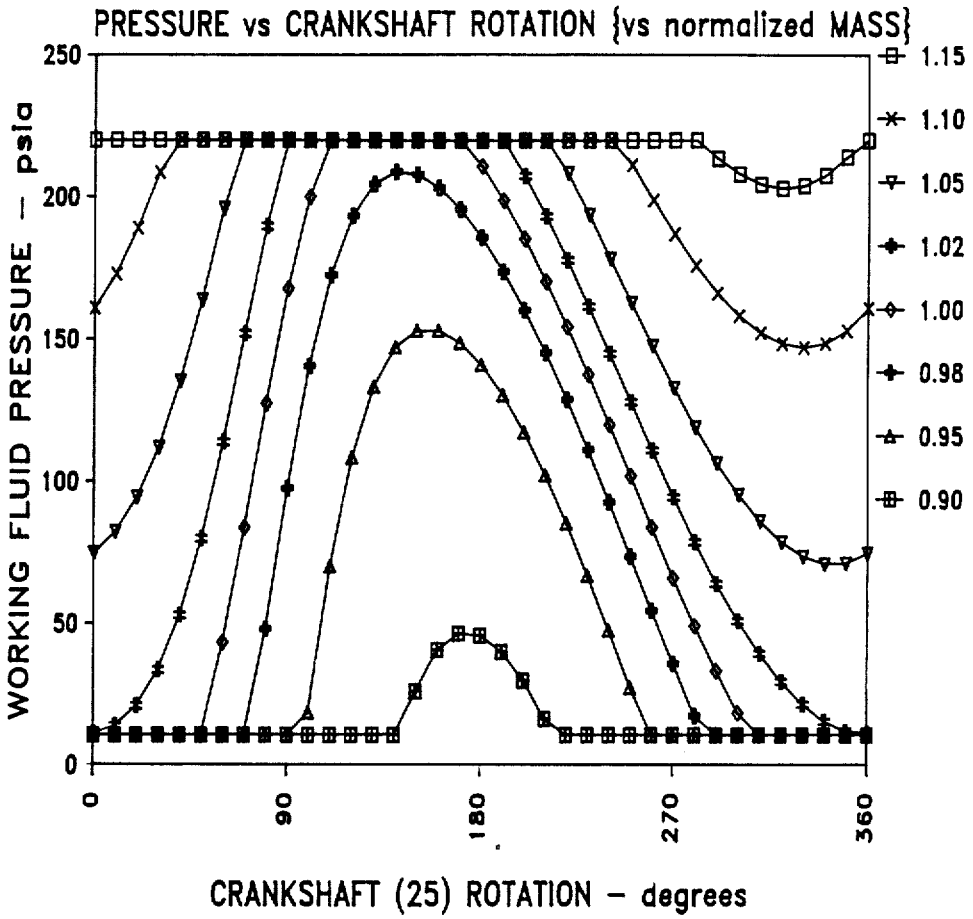

To illustrate the ease with which this type of control can vary engine output, FIG. 12 shows the resulting engine pressures versus crankshaft 25 position in the disclosed embodiment, but wherein the quantity of enclosed working fluid mass is effectively varied from 2, 5, 10, and 15% above the nominal example of FIG. 4, to 2, 5, and 10% below the nominal example of FIG. 4.

Figure 13A:
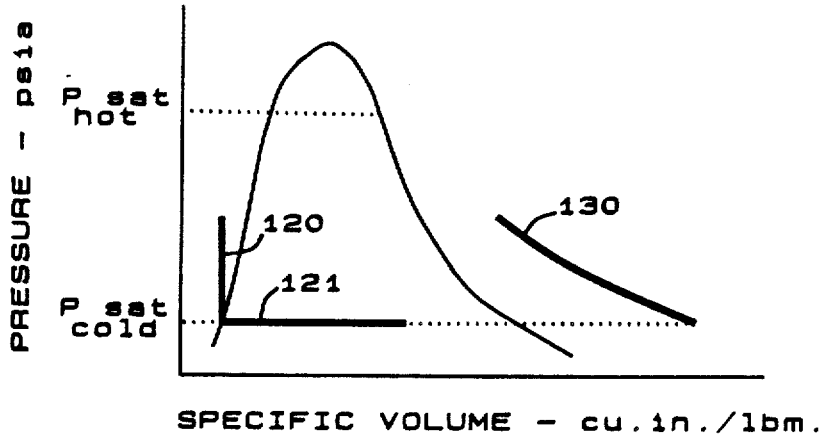
FIGS. 13 through 19 graphically illustrate the effects in the pressure-volume (PV) plane of the selectively variable control means employed in the preferred embodiment of FIG. 1.

In theory, the thermodynamic characteristics in the Pv realm when excessive or insufficient working fluid is present as a result of control should take the shape as shown in FIG. 13. FIG. 13A shows the shift toward operation in the superheated region. This results in a longer horizontal isotherm 121 in the cold chamber, when there is reduced mass in the system as a result of actuation of the control cylinder. That is, the working fluid is subjected to isobaric conditions in the cold chamber for a longer period of time during the operational cycle.

Figure 13B:
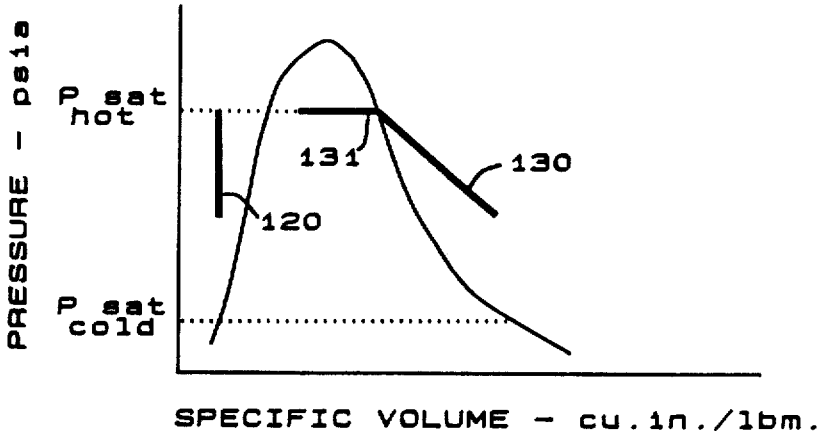

On the other hand, FIG. 13B illustrates a shift toward operation in the liquid region. Note that the isotherm 131 of the hot chamber is longer relative to that of FIG. 5A or 5B, meaning that the working fluid is subjected to isobaric conditions in the hot chamber for a relatively longer period of time during the operational cycle.

Figure 14:
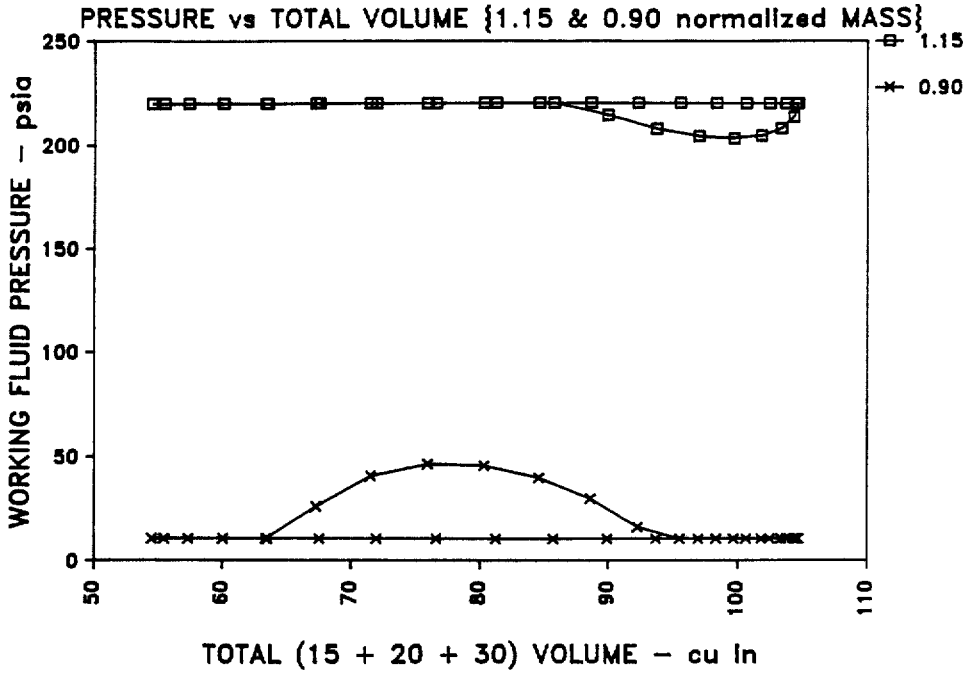

FIGS. 14–19 graphically illustrate the results of calculated pressures versus total volume for seven of the cases of FIG. 12 with FIG. 14 showing the two extremes cases of 15% above and 10% below the nominal mass value. It should be noted that the enclosed PV areas and hence the work outputs are minimal and that any further increase or decrease in the mass, respectively, will result in the engine staying at either the 219.9 psia or 10.5 psia pressures.

Figure 15:
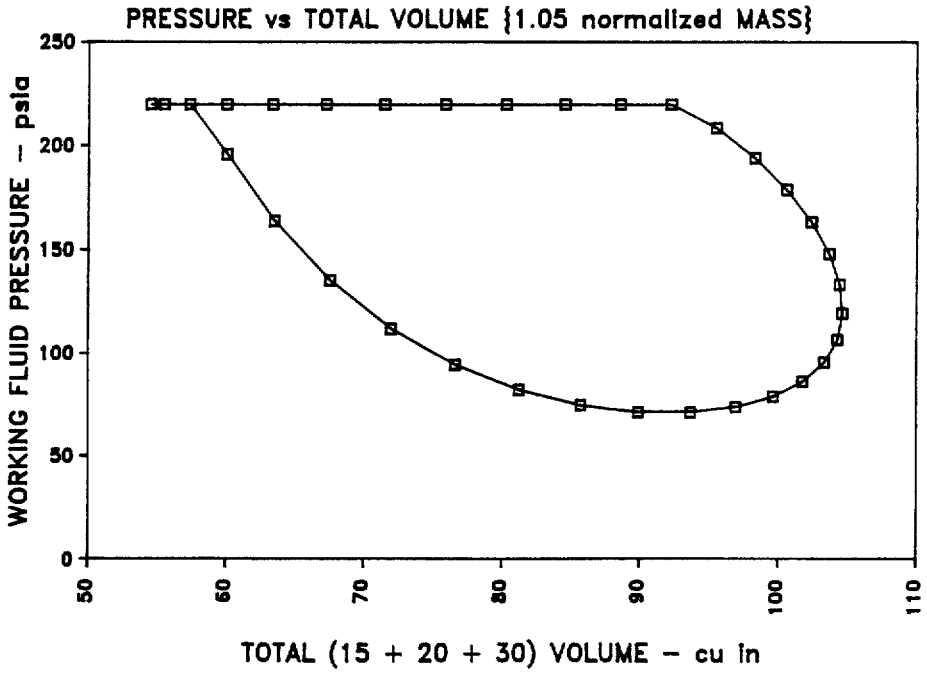
Figure 16:
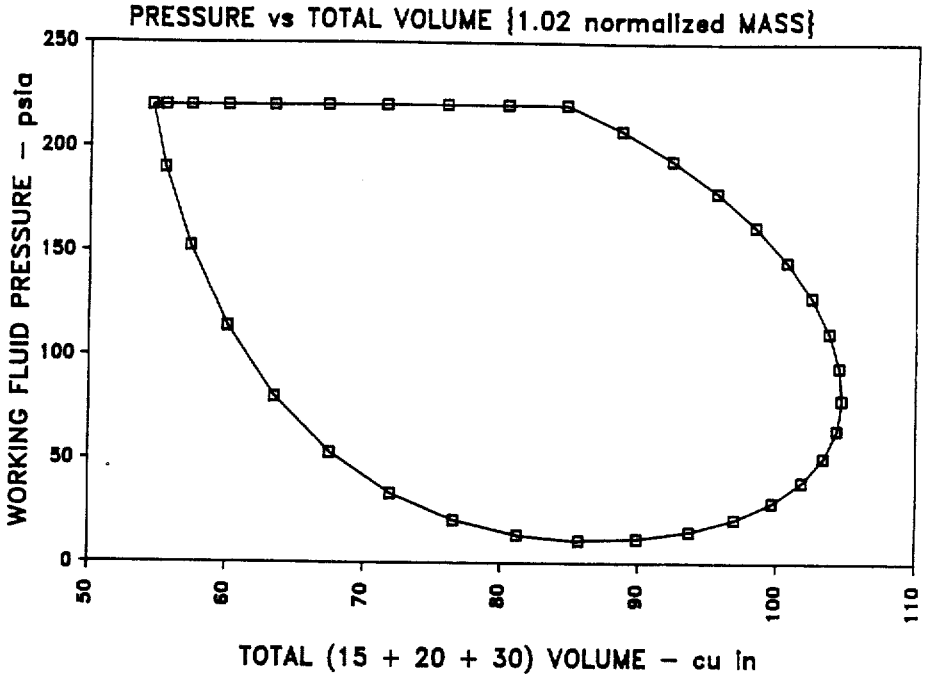
Figure 17:
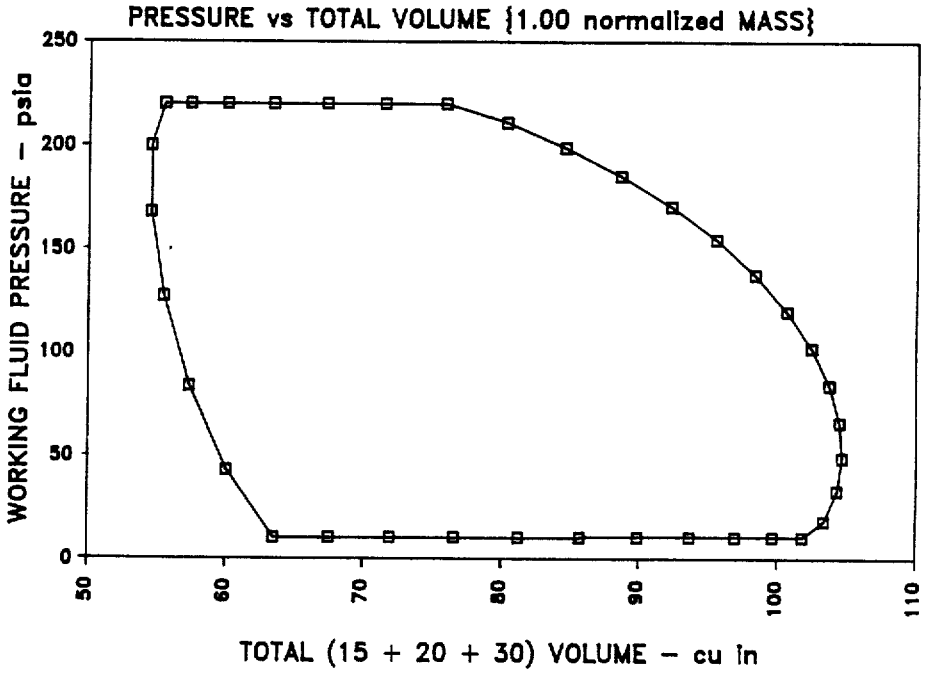

The four cases with too much working fluid mass (1.02, 1.05, 1.10, and 1.15) can be seen in FIG. 12 and in FIGS. 14, 15, and 16 to remain at the 219.9 psia level for progressively longer portions of each cycle without ever reaching the lower 10.5 psia saturation pressures. In other words, operation of an engine with too much mass results in a shift toward the liquid region with more of the cycle in the hot temperature wet liquid-vapor state and less of the cycle in the superheated state.

Figure 18:
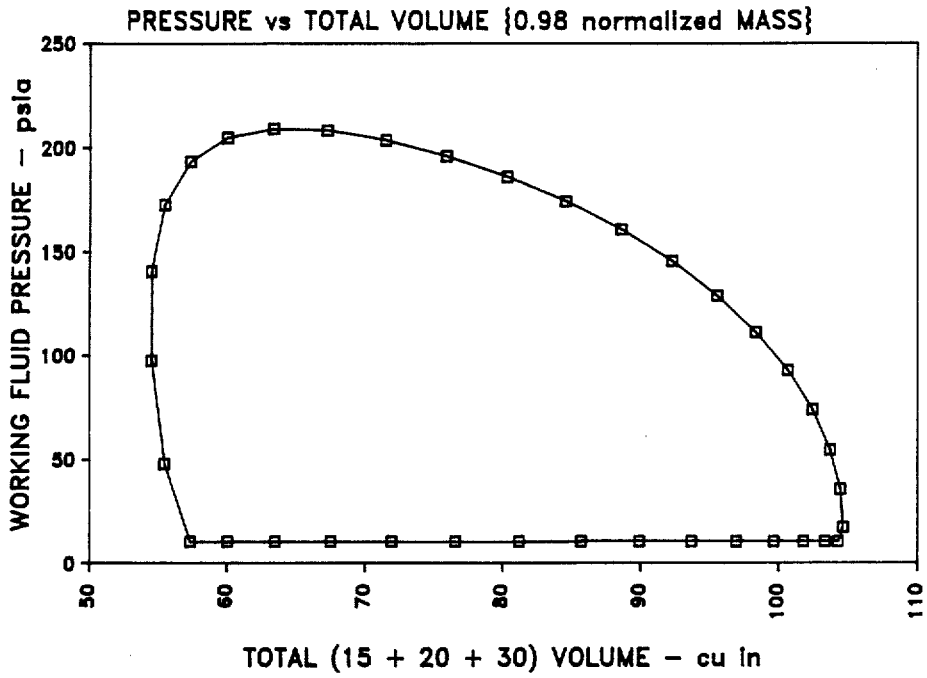
Figure 19:
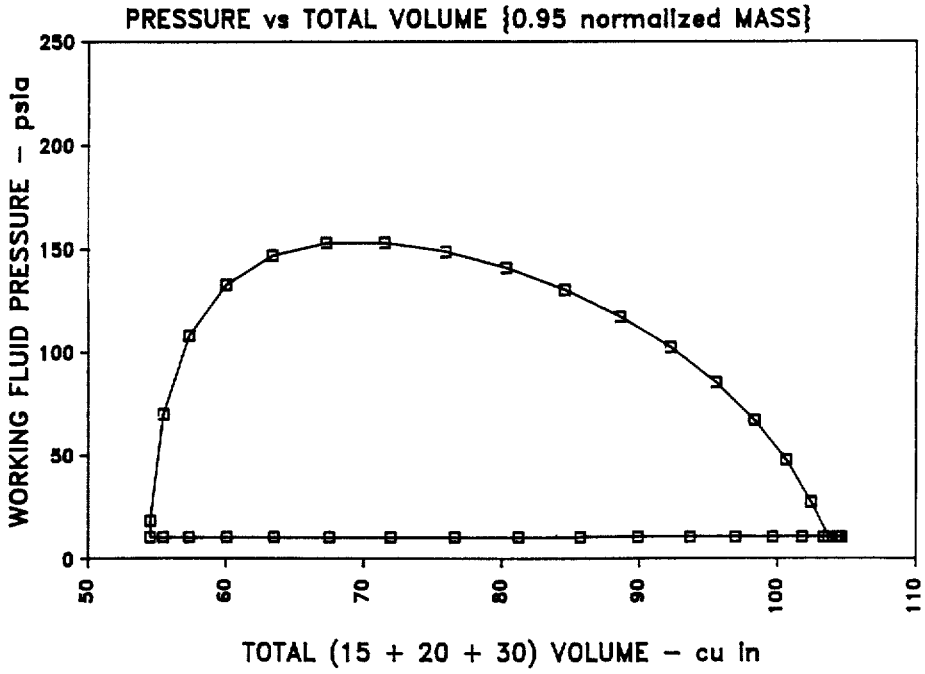

In a similar manner, the three cases with too little working fluid mass (0.98, 0.95, and 0.90) can be seen in FIG. 12 and FIGS. 18, 19 to remain for progressively longer portions of each cycle at the 10.5 psia saturation pressure with less or no part of the cycle reaching the 219.9 psia pressure. In other words, too little mass results in a shift toward the superheated region with more of the cycle in the cold temperature wet liquid-vapor state and less of the cycle in the liquid state. Only the nominal case of FIG. 17, with working fluid mass equal to the normalized 1.00, can be seen to operate at both the low and high saturation pressures with the previously stated approximate ¾ and ¼ state ratios. This net effect of changing the quantity of working fluid mass for the seven cases shown in FIGS. 12 and 14–19 can be summarized as follows:

| EFFECTIVE MASS | | CONTROL | CONSTANT PRESSURE OPERATION | | ENGINE OUTPUT | |
|---|---|---|---|---|---|---|
| in | normalized | SPACE 67 | in percent at | | in | |
| lbs | to * example | in cu. in. | 219.9 | 10.5 | ft-lbs | percent |
| 1.90889 | 1.15 | 14.515 | 99.4 | 0.0 | 17.0 | 2.4 |
| 1.82540 | 1.10 | 13.010 | 57.2 | 0.0 | 147.9 | 20.8 |
| 1.74290 | 1.05 | 11.505 | 39.4 | 0.0 | 415.9 | 58.5 |
| 1.69311 | 1.02 | 10.782 | 27.8 | 0.1 | 649.4 | 91.3 |
| *1.65991 | 1.00 | 10.0 | 16.7 | 28.8 | 711.5 | 100.0 |
| 1.62671 | 0.98 | 9.398 | 0.0 | 41.1 | 652.5 | 91.7 |
| 1.57691 | 0.95 | 8.495 | 0.0 | 55.0 | 439.1 | 61.7 |
| 1.49392 | 0.90 | 6.990 | 0.0 | 80.0 | 59.6 | 8.8 |

* = preferred embodiment - nominal

It can thus be seen that a small change in control space 67 will vary the effective mass, which will then significantly alter and hence control engine output. Also, any mass values slightly above or slightly below the extremes shown in the table can be used for complete and rapid engine shutdown with the engine pressure remaining at either the hot or cold saturation pressure respectively, regardless of where in the cycle the engine stops. It is also contemplated that control space 67 could be used for braking of an inertia load for purposes of slowing or stopping it in a controlled manner. One last additional advantage of control space 67 is that it will provide a means for an occasional adjustment in the mass as required to compensate for the inevitable leakage of working fluid past the working piston seals and/or piston drive rod seals, a practical problem well known in the art.

The initial quantity of working fluid mass placed in the engine is essential if control space 67 is to have a range of control in both directions. The approximate value for finding this starting mass is simply to first calculate the numerical sum of the cold chamber 20 fixed working fluid sapces 62, 63, 66 and variable working fluid spaces 65 (with cold piston 22 at bottom dead center), and with control piston 24 approximately midway in control cylinder 53. If this sum (in cubic inches) is then divided by the specific volume of the working fluid (in cubic inches per pound of mass) as it exists as a saturated liquid at the cold temperature, the result is the approximate (within a range of plus or minus 10%) initially required mass in pounds for the engine. Control piston 24 can then be adjusted to optimize the desired performance criteria, e.g., scaled down by 1.15% for maximum output in the numerical example, as follows:

SUM = 10 (for space 62) + 5 (for space 63,66) + 5.4 (for space 65) + 10 (for control space 67)
= 30.4 cubic inches.

STARTING MASS in lbs. = 30.4/18.04 = 1.68514 lbs.

OPTIMUM MASS = STARTING MASS × 0.985 {max output}
= 1.68514 × 0.985
= 1.65991 lbs (normalized as the 1.00 case in FIG. 12 and used in the nominal example of FIGS. 4 and 6–11).

Effects of Volume Changes on Operation

Next will be discussed the relative volume design determinations and their effect on the resulting thermodynamic processes. First, it is informative to consider a maximum output design wherein the cold chamber is operating in a liquid state for approximately ½ of each cycle and in a wet vapor state for the other approximately ½ of each cycle; and simultaneously, the working fluid in the hot chamber operating in a wet vapor state for approximately ½ of each cycle and in a superheated vapor state for the other approximately ½ of each cycle. In other words, operate the maximum time each cycle at the two saturation pressure extremes of 219.9 and 10.5 psia, i.e., isobaric processes, and minimize the time each cycle passes through the transition pressures. Operation in this mode would require that the mass quantity be again adjusted for maximum output and secondly, that the cold variable space 65 be made equal to the hot variable space 45 in order to achieve the ½ ratios. However, there are drawbacks which occur in this case: there is a poor 1:1 swept volume ratio, a high cost, and a poor thermal efficiency (due to the large cold mass being transferred). While operation in such a mode may be desirable in some applications, for the most part it is believed that some value other than a 1:1 relative ratio would be more practical.

Figure 20:
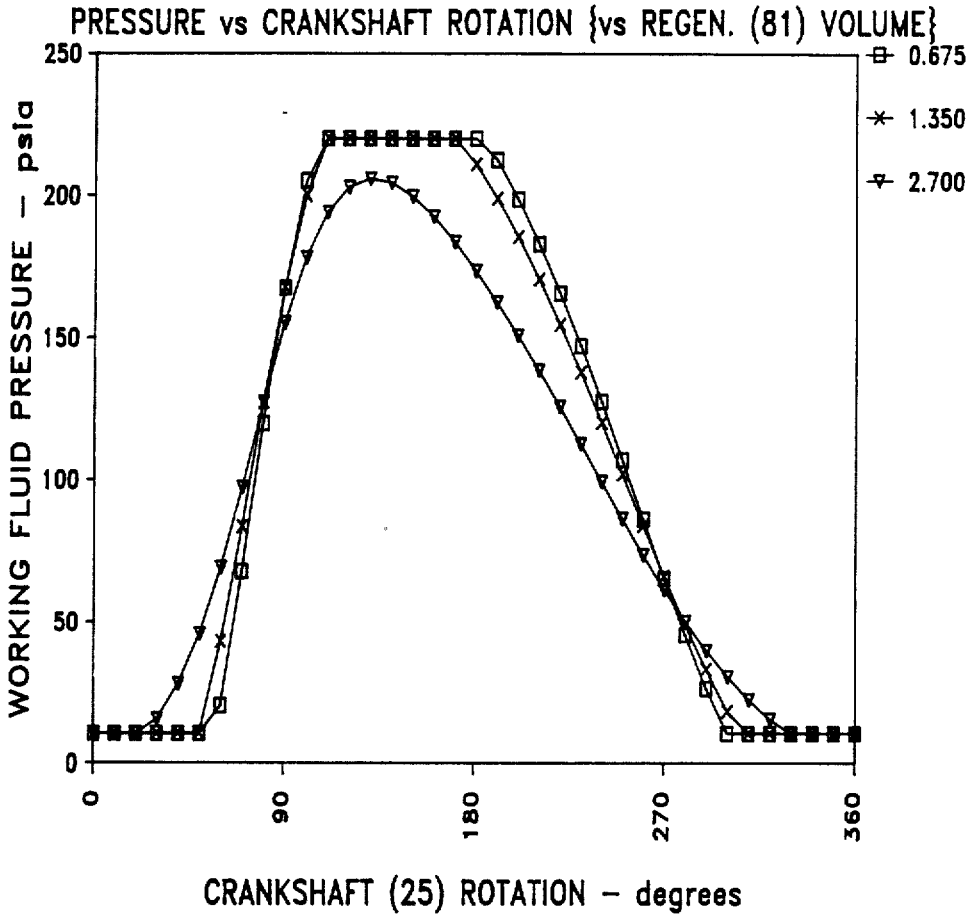
FIGS. 20 through 23 are graphs showing the different pressure effects achieved with alternate embodiments of the present invention.

Before considering other relative volume ratio values, any changes made in the cold variable space 65 volume cannot be uncoupled for purposes of comparison from the regenerator void space 81. To understand why this occurs, see FIG. 20, which is a graphical illustration of the effect of different volumes for the regenerator void space 81 on the engine pressure versus crankshaft 25 position plot, with the 1.35 cubic inch volume being that of the nominal example. The other two cases shown of 0.675 and 2.70 cubic inches are simply ½ and twice the 1.35 volume with all the other variables being held constant, except for the mass which was varied to obtain maximum output. The resulting engine net outputs are: (1) 746.5 ft-lbs at 0.675 cubic inches, (2) 711.5 ft-lbs at 1.35 cu. in., and (3) 567.6 ft-lbs at 2.70 cu. in. Thus, the outputs, and FIG. 21 indirectly, show the progressive degradation that occurs as a result of increasing the regenerator void space 81 when at the same time, the other volumes are not changed.

In a like manner, if the volume of cold variable space 65 is decreased with all other volumes unchanged including the regenerator, serious output degradation will again occur, primarily as a result of the "relative" increase in regenerator void space 81 over the variable cold space 65. Hence, if the effect of changing cold space 65 independently is to be correctly analyzed, the relative volume ratio of the nominal example, i.e. space 65 having a volume four times that of space 81, needs to be maintained.

Figure 21:
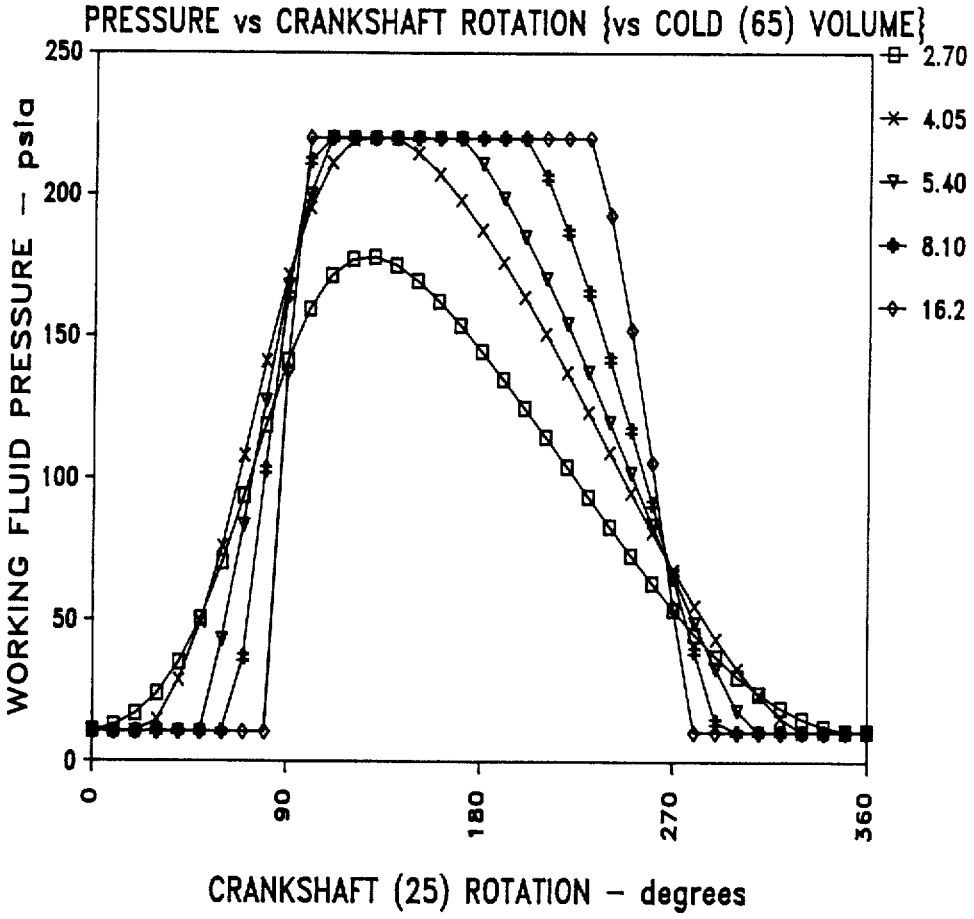

FIG. 21 is a graphical illustration showing the effect of varying the cold variable space 65 while keeping the regenerator void space 81 at a one-fourth relative value. It shows five different values for the volume of cold variable space 65 when plotted as a function of pressure versus crankshaft position. For each case plotted: (1) the regenerator void space 81 is made to be one-fourth of the cold space 65, (2) the mass is chosen so as to optimize the engine output, and (3) all the other variables are held constant. The results of the five different values are discussed in the following paragraphs but they are in effect, three different embodiments, with the 5.4 cubic inch case being the nominal example of the preferred embodiment, with the 16.2 case approaching the maximum output, with the 2.7 case approaching the optimum thermal efficiency, and the other two cases being in-between combinations.

It will be understood that the different results illustrated in FIG. 21 are considered alternate embodiments since different thermodynamic processes, and therefore different thermodynamic cycles, occur as a result of using different design volume ratios, e.g. (a) the 2.7 case can be seen in FIG. 21 to have no isobaric processes but a PV plot would show two near isothermal processes and two near isometric processes, which is therefore closer to a gas Stirling cycle; and (b) the 16.2 case can be seen in FIG. 21 to be two predominately isobaric processes and a PV plot would also show two near isothermal processes, which is therefore closer to an Ericsson cycle. Nonetheless, it should be understood that the combination thermodynamic cycle aspects of the present invention are present in each of these cases nonetheless, since the ideal Stirling or Ericsson cycles are not realized.

A reasonable construction of a maximum output embodiment is with the cold variable space 65 volume being 16.2 cubic inches, or four times the value calculated in the nominal example of the preferred embodiment. This alternative embodiment can be seen in FIG. 21 as the 16.2 case; further, it has a swept volume ratio of 3.1 and an output improvement of 15% over the nominal example. However, any further increases in the size of the variable cold space 65 (as in the 1:1 swept volume ratio discussed above) show smaller and smaller improvements in net output and may not be feasible in terms of operation or economics.

On the other hand, the optimum thermal efficiency embodiment would intuitively be one in which the cold chamber fluid always remains as a liquid while the hot chamber always remains a superheated vapor, i.e., no wet vapor state occurs, except in the regenerator chamber, and the engine pressures are always in the transitional region between the saturation pressures. This embodiment, assuming the mass quantity is again adjusted for maximum output, requires that the cold variable space 65 be equal to one-half, or 2.7 cubic inches, of the volume computed in the nominal example. This high thermal efficiency embodiment can be seen in FIG. 21 as the 2.70 case and it does result, as might be expected, in sacrificing one-third of net engine output.

Figure 22A:
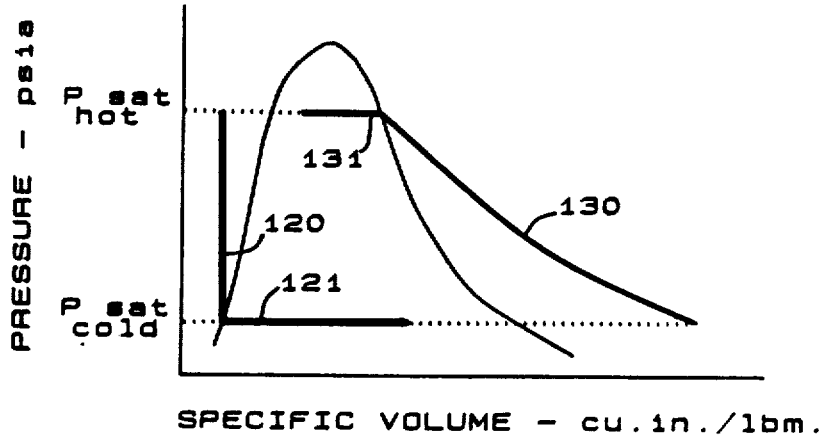
Figure 23:
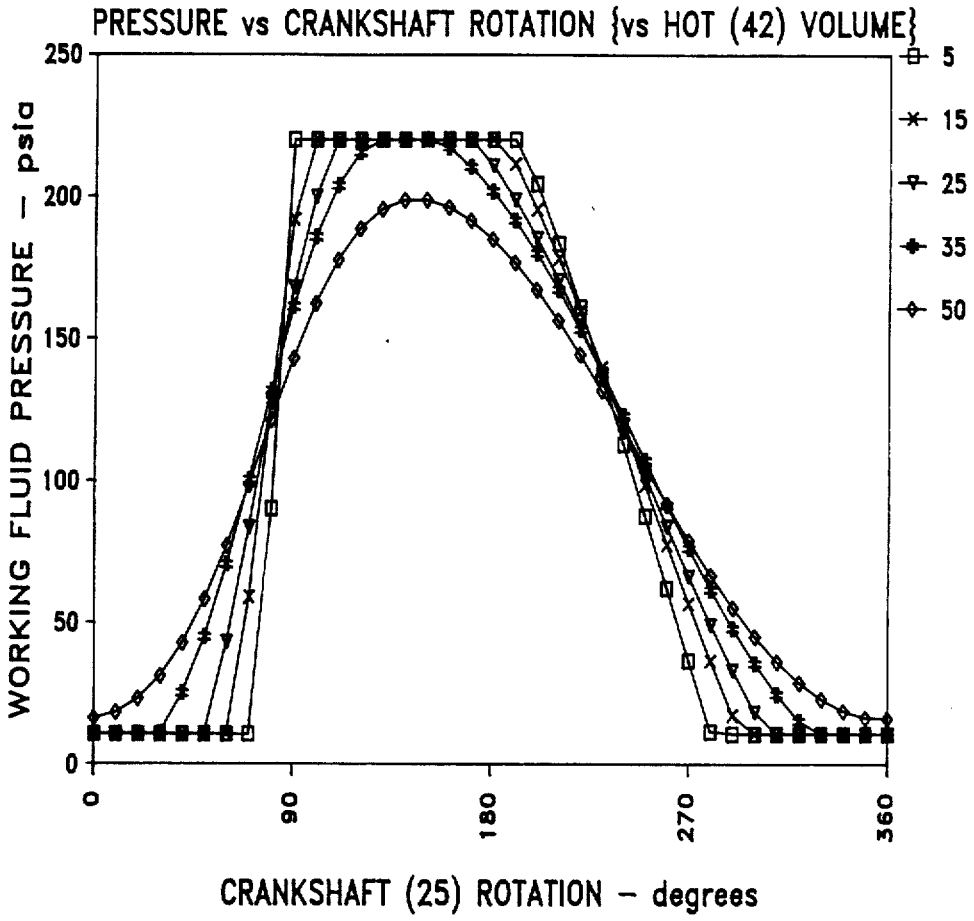

FIG. 22A represents the theoretical expected Pv results of the 16.2 case of FIG. 21 and the 5 case of FIG. 23. It will be noted that selection of these particular parameters results in operation with significant isobaric processes represented by the isotherms 121, 131. Accordingly, the situation in this case may be considered an alternate embodiment.

Figure 22B:
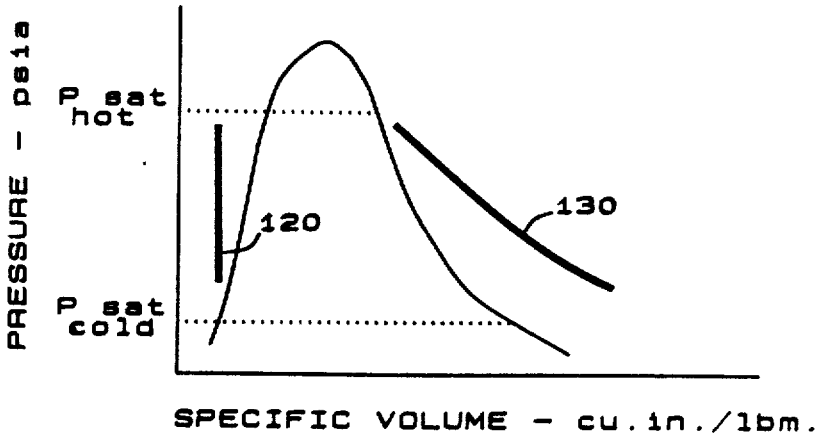

Likewise, FIG. 22B represents the theoretical expected Pv results of the 2.70 case of FIG. 21 and the 50 case of FIG. 23. In this case, it will be seen that only minimal, if any, isobaric processes whatsoever are expected in the hot and cold chambers.

The effects in terms of the various disclosed embodiments, thermodynamic cycles, and engine outputs as a result of varying the cold variable space 65 (as shown in the five cases of FIG. 21) can be summarized as follows:

| CYCLE EMBODIMENT | THERMODYNAMIC CHARACTERISTICS in terms of constant pressure | COLD SPACE 65 in cu. in. | REGEN. SPACE 81 in cu. in. | MAXIMUM OUTPUT in ft-lbs |
|---|---|---|---|---|
| THERMAL EFF. | 0 degrees | 2.70 | 0.675 | 464.3 |
| | 74 degrees | 4.05 | 1.0125 | 625.1 |
| *OPTIMUM COMB. | 164 degrees | 5.40 | 1.35 | 711.5 |
| | 228 degrees | 8.10 | 2.025 | 777.2 |
| MAX POWER | 292 degrees | 16.2 | 4.05 | 818.4 |

*preferred embodiment - nominal

Hot fixed space 42 is the only other volume chosen independently relative to the hot variable space 45, and which affects both output performance and results in different thermodynamic processes. This space 42 is also the one in which the important hot heat exchanger function is accomplished. FIG. 23 is a graphical illustration showing the effect of varying the hot fixed space 42 while all other variables are held constant except for the mass quantity which is again chosen to optimize engine output. The results in terms of net work output for the five different values of space 42 are as follows: (1) 757.4 ft. lbs @ 5 cu. in. (minimum for passageways; and voids), (2) 740.6 ft. lbs @ 15 cu. in., (3) 711.5 ft. labs. @ 25 cu. in. (preferred embodiment), (4) 665.1 ft. lbs. @ 35 cu. in., and (5) 558.0 ft. lbs. @ 50 cu. in. As can be seen, the degradation penalty for providing a large hot heat exchanger chamber 42 with all its numerous attendant benefits is offset by the small loss in net work output of 6% when going from the minimum volume case (1) to the preferred embodiment case (3). Again, as previously described for design volume variations in cold space 65, the extreme cases of 5 cu. in. and 50 cu. in. for hot space 45 result in different thermodynamic cycles, i.e. with and without isobaric processes respectively, and therefore represent alternate embodiments.

As has been shown, the values chosen for the hot and cold, fixed and variable volumes, relative to each other, involve tradeoffs that are primarily between maximum output and thermal efficiency, with such tradeoffs being standard in the art. More importantly, the relative volume ratios chosen significantly effect the resulting thermodynamic processes and thermodynamic cycles of operation of the present invention, wherein: (1) the preferred embodiment ratios were chosen for the example working fluid at the example specified temperatures and as a compromise between the many possible alternate embodiments represented by the different workable ratios of which some were graphically illustrated, and (2) failure to stay within the specified relative volume ranges can easily result in a machine with zero output. Therefore, the stated determinations in the present invention for finding and controlling the quantity of working fluid mass, and for determining the relative volume ratios, are both essential parts of the invention if practical and useful engine operation is to result.

Although specific embodiments have been described, it will be understood by those skilled in the art that various modifications may be made without departing from the spirit of the invention which is intended to be limited solely by the appended claims:

What is claimed is:

1. A heat machine, comprising:

a hot chamber having a fixed volume and a variable hot volume;

a cold chamber having a fixed volume and a variable cold volume;

a heat regenerator chamber in fluid communication between said hot chamber and said cold chamber, said regenerator chamber including heat retaining means;

means for coupling said variable hot volume and said variable cold volume to provide a predetermined maximum pressure and a predetermined minimum pressure within said hot chamber, said cold chamber, and said regenerator chamber, at different portions of a cycle;

means for supplying heat to said hot chamber to maintain a predetermined high temperature;

means for removing heat from said cold chamber to maintain a predetermined low temperature;

a predetermined mass of working fluid in said hot chamber, said cold chamber, and said regenerator chamber, said working fluid being selected to enter or be near a wet liquid vapor state at a said predetermined high temperature and said maximum pressure and to enter or be near a wet liquid vapor state at said predetermined low temperature and said minimum pressure; and working fluid mass control means for varying the effective quantity of mass present in said cold chamber to provide for output control.

2. The heat machine of claim 1, wherein said heat machine has a swept volume ratio greater than about 2.5.

3. The heat machine of claim 2, wherein said heat machine has a swept volume ratio of about 9.3.

4. The heat machine of claim 1, wherein said working fluid mass control means comprises a control cylinder in fluid communication with said cold chamber, said control cylinder having a selectively variable volume.

5. The heat machine of claim 4, wherein said hot chamber has a fixed volume of about 25 cubic inches and a variable volume of about 50 cubic inches, wherein said cold chamber has a fixed volume of about 15 cubic inches and a variable volume of about 5.4 cubic inches, and said control cylinder has a selectively variable volume of between about about zero and about 20 cubic inches.

6. The heat machine of claim 4, wherein said regenerator has a fixed volume less than the volume of said cold chamber variable volume.

7. The heat machine of claim 6, wherein said regenerator has a fixed volume less than one half the volume of said cold chamber variable volume.

8. The heat machine of claim 1, wherein the working fluid in said cold chamber enters and remains in a sub-cooled liquid state, a saturated liquid state, or a wet liquid vapor state during all portions of a cycle.

9. The heat machine of claim 8, wherein the working fluid in said cold chamber is in a sub-cooled liquid state for about three fourths of a cycle and a wet liquid vapor state for about one fourth of said cycle, and the working fluid in said hot chamber is in a superheated vapor state for about three fourths of said cycle and a wet liquid vapor state for about one fourth of said cycle.

10. The heat machine of claim 1, wherein a pressure/volume diagram of a cycle of the machine exhibits a convex shaped region on the transition from a relatively constant high pressure to a relatively constant low pressure.

11. The heat machine of claim 1, wherein said predetermined mass of working fluid is initially set at an initial mass such that the engine operates between said maximum high pressure at said predetermined high temperature and said minimum pressure at said predetermined low temperature, and wherein said working fluid mass control means is operative to effectively increase or decrease the amount of said predetermined mass of working fluid in the engine.

12. The heat machine of claim 11, wherein the pressure within said machine remains at said maximum pressure for longer portions of a cycle when said working fluid mass control means is caused to effectively introduce more mass than said initial mass into the engine.

13. The heat machine of claim 11, wherein the pressure within said machine remains at said minimum pressure for longer portions of a cycle when said working fluid mass control means is caused to effectively remove mass from said initial mass in the engine.

14. The heat machine of claim 11, wherein said working fluid mass control means is operative to cause more of the working fluid to be in a liquid state for longer portions of a cycle by effectively adding more working fluid to the machine.

15. The heat machine of claim 11, wherein said working fluid mass control means is operative to cause more of the working fluid to be in a superheated vapor state for longer portions of a cycle by effectively removing more working fluid from the machine.

16. A cyclical heat machine, comprising:

means for containing a working fluid in an overall closed space in a constant mass throughout repeated cycles, said working fluid existing during one cycle in varying states of cold sub-cooled liquid, cold saturated liquid, cold wet liquid vapor, hot wet liquid vapor, hot saturated vapor, and hot superheated vapor;

means for supplying heat to the working fluid during portions of a cycle to cause said working fluid to enter said hot wet liquid vapor, said hot saturated vapor or said hot superheated vapor states;

means for removing heat from the working fluid during portions of a cycle to cause said working fluid to enter said cold sub-cooled liquid or said cold saturated liquid, or said cold wet liquid vapor states; and control means for selectively varying the effective working fluid mass to control the level of useful machine output, said control means being selectively operative for causing more of said working fluid to be in said cold sub-cooled liquid state for longer periods in a given cycle by increasing the effective mass in said containing means, and alternatively being selectively operative for causing more of said working fluid to be in said saturated vapor or said superheated vapor states for longer periods in a given cycle by decreasing the effective mass in said containing means.

17. A heat machine, comprising:

a substantially isothermal hot chamber having a fixed volume and a variable hot volume, said variable hot volume comprising a substantially sinusoidally variable expansion space for a working fluid;

a substantially isothermal cold chamber having a fixed volume and a variable cold volume, said variable cold volume comprising a substantially sinusoidally variable compression space for said working fluid;

said variable hot volume and said variable cold volume providing a swept volume ratio of at least 2.0;

means for supplying heat to said hot chamber to a predetermined high temperature;

means for removing heat from said cold chamber to a predetermined low temperature;

a heat regenerator chamber in fluid communication between said hot chamber and said cold chamber, said regenerator chamber including heat retaining means, said regenerator being at a temperature that varies cyclically between said heating means and said cooling means, said regenerator having a fixed volume less than the one half of the volume of said variable cold volume;

means for connecting said hot chamber, said cold chamber, and said heat regenerator in fluid communication with each other such that there are substantially negligible flow losses and there is substantially evenly distributed pressure at all times of a cycle throughout said hot chamber, said cold chamber, and said heat regenerator;

means for mechanically coupling said variable hot volume and said variable cold volume to provide a cyclical variation between a predetermined maximum pressure and a minimum volume, and a predetermined minimum pressure and a maximum volume, within said hot chamber, said cold chamber, and said regenerator chamber;

a predetermined mass of working fluid in said hot chamber, said cold chamber, and said regenerator chamber, said working fluid being selected to enter a hot wet liquid vapor state at a said predetermined high temperature and said maximum pressure and to enter a cold wet liquid vapor state at said predetermined low temperature and said minimum pressure; and a pressure/volume diagram of a cycle of the machine exhibiting a convex shaped region on the transition from said maximum pressure to said minimum pressure.

18. A method for cycling a working fluid in a closed volume heat machine, comprising the steps of:

providing a predetermined quantity of a working fluid within a closed volume, the working fluid being changeable from a sub-cooled liquid to a superheated vapor at a predetermined temperature and a predetermined pressure; and for each cycle taking the following steps:

compressing the working fluid in a cold chamber at a temperature below said predetermined temperature to cause the working fluid to enter the sub-cooled liquid state;

adding heat to the working fluid in a hot chamber while the working fluid is subjected to a relatively constant high pressure above said predetermined pressure, until the working fluid temperature exceeds said predetermined temperature;

allowing the working fluid to expand in a hot chamber at a temperature above said predetermined temperature as it changes phase from said sub-cooled liquid state to a superheated vapor state against the resistance of a working surface; and removing heat from the working fluid in the cold chamber while the working fluid is subjected to a relatively constant low pressure below said predetermined pressure, until the working fluid temperature is below said predetermined temperature; and at least during some cycles, periodically varying the effective mass of the working fluid within the closed volume with mass varying means to control the work output of the machine.

19. The method of claim 18, wherein the method is performed in a Stirling cycle machine.

20. The method of claim 19, wherein the swept volume ratio of said Stirling cycle machine is greater than about 2.0.

21. The method of claim 18, wherein the method is performed in an Ericsson cycle machine.

22. The method of claim 21, wherein the swept volume ratio of said Ericsson cycle machine is greater than about 2.0.

23. The method of claim 18, wherein the working fluid is an organic working fluid.

24. The method of claim 23, wherein the working fluid is Freon 113.

25. The method of claim 18, wherein the cold chamber and the hot chamber both are relatively isothermic, and wherein the working fluid in the cold chamber is in the liquid saturated state for about three-fourths of each cycle and in a wet liquid vapor state about one-fourth of said cycle, and wherein the working fluid in the hot chamber is in the superheated vapor state for about three-fourths of said cycle and in a wet liquid vapor state about one-fourth of said cycle.

26. A cyclical heat machine, comprising:

means for providing a closed cyclically varying volume for containing a working fluid;

a predetermined initial mass of working fluid contained within said closed volume, said working fluid being changeable from a sub-cooled liquid to a superheated vapor at a predetermined temperature and a predetermined pressure;

means for suppyling heat to said working fluid to a temperature above said predetermined temperature when said volume varying means provides a minimum volume to cause the working fluid to expand to a maximum pressure;

means for removing heat from said working fluid to a temperature below said predetermined temperature when said volume varying means provides a maximum volume to cause the working fluid to contract to a minimum pressure;

said predetermined mass of working fluid being of an initial mass such that the engine operates between said maximum pressure at temperatures above said predetermined temperature, and said minimum pressure at temperatures below said predetermined temperature; and control means for selectively varying the quantity of working fluid with said closed volume, said control means being operative to effectively increase or decrease the mass of working fluid in said closed volume.

27. The heat machine of claim 26, wherein a pressure/volume diagram of a cycle of the machine exhibits a convex shaped region on the transition from said maximum pressure to said minimum pressure.

28. The heat machine of claim 26, wherein the pressure within said engine remains at said maximum pressure for longer portions of a cycle when said control means is caused to effectively introduce more mass into the engine than said initial mass.

29. The heat machine of claim 26, wherein the pressure within said engine remains at said minimum pressure for longer portions of a cycle when said control means is caused to effectively remove mass from said initial mass in said engine.

30. The heat machine of claim 26, wherein said control means is operative to cause more of the working fluid to be in a sub-cooled liquid state for longer portions of a cycle by effectively adding more working fluid to the engine.

31. The heat machine of claim 26, wherein said control means is operative to cause more of the working fluid to be in a superheated vapor state for longer portions of a cycle by effectively removing more working fluid from the engine.

32. A cyclical heat machine, comprising:

a substantially isothermic cold chamber having a working fluid in a subcooled state for approximately three-fourths of an operating cycle and in a wet liquid-vapor state for the other approximately one-fourth of each said cycle; and a substantially isothermic hot chamber having a working fluid in a superheated vapor state for approximately three-fourths of each said cycle and in a wet liquid-vapor state for the other approximately one-fourth of each said cycle.

33. The cyclical heat machine of claim 32, further comprising heat regenerator means operatively positioned between said cold chamber and said hot chamber, and wherein said working fluid changes between said subcooled state, said wet liquid-vapor state, and said superheated vapor state during various portions of an operating cycle.

34. The cyclical heat machine of claim 32, further comprising control means for varying the effective mass of working fluid in said cold chamber and said hot chamber to control the work output of the machine.

* * * * *